US006819972B1

(12) United States Patent
Martin et al.

(10) Patent No.: US 6,819,972 B1
(45) Date of Patent: Nov. 16, 2004

(54) MATERIAL SURFACE PROCESSING WITH A LASER THAT HAS A SCAN MODULATED EFFECTIVE POWER TO ACHIEVE MULTIPLE WORN LOOKS

(76) Inventors: Clarence H Martin, 290 Eastchester Ct., Gahanna, OH (US) 43230; Darryl J. Costin, 29261 Notingham Ct., Westlake, OH (US) 44145

( * ) Notice: Subject to any disclaimer, the term of this patent is extended or adjusted under 35 U.S.C. 154(b) by 468 days.

(21) Appl. No.: 09/653,997

(22) Filed: Sep. 1, 2000

Related U.S. Application Data

(60) Provisional application No. 60/157,904, filed on Oct. 5, 1999.

(51) Int. Cl.[7] ..... G06F 19/00

(52) U.S. Cl. ..... 700/166; 700/131; 700/132; 219/161.68; 219/121.69

(58) Field of Search ..... 700/130, 131–132, 700/133, 129, 137, 142, 166, 119, 122, 127; 219/121.68, 121.69, 121.85, 14.85

(56) References Cited

U.S. PATENT DOCUMENTS 5,017,423 A * 5/1991 Bossmann et al. ..... 428/224
5,436,027 A * 7/1995 Offer ..... 427/10
5,567,207 A * 10/1996 Lockman et al. ..... 8/444
5,652,805 A * 7/1997 Ooenoki et al. ..... 382/141
5,899,964 A * 5/1999 Ooenoki et al. ..... 702/150
5,916,461 A * 6/1999 Costin et al. ..... 219/121.68
5,990,444 A 11/1999 Costin ..... 219/121.69
6,002,099 A * 12/1999 Martin et al. ..... 219/121.69
6,252,196 B1 6/2001 Costin et al. ..... 219/121.69

* cited by examiner

*Primary Examiner*—Ramesh Patel

(57) ABSTRACT

Techniques which enable changing certain amount of energy being applied from a laser to a material during scan lines of the laser. Energy can be applied to a material to change its look. Different energies can be applied within a single scan line to the material. A display can represent the pattern, by showing different areas of change to the material as different colors/looks on the display. For example, the color of the display can represent the amount of energy being applied to a specific position represented by that color. Since the amount of energy that is applied can change within a single scan line, and in fact may change multiple times within that scan line, this enables freely setting the characteristics.

95 Claims, 13 Drawing Sheets

MATERIAL SURFACE PROCESSING WITH A LASER THAT HAS A SCAN MODULATED EFFECTIVE POWER TO ACHIEVE MULTIPLE WORN LOOKS

CROSS REFERENCE TO RELATED APPLICATIONS

This application claims the benefit of the U.S. Provisional Application No. 60/157,904, filed on Oct. 5, 1999.

BACKGROUND

Denim and other material garments have often been processed to make them look worn. Consumers have shown a desire to purchase broken-in garments.

Currently available techniques of processing such garments include mechanical sandblasting with sand or other abrasive; hand, mechanical, or robotic rubbing, and others. The effects may include local abrasion which is a wear pattern from below the waist to below the knee section. Another effect is global abrasion, which describes a wear pattern from below the waist to the cuff. "Whiskers" are a term which describes the wear that occurs along the creases and hem of the article during wear. Yet another worn look is a rectangular area marked on the rear pocket of the jean, which simulates the worn look caused from carrying a wallet in the back pocket. Yet another worn look is referred to as "frayed", where the degree of wear is so severe that the individual threads of the cotton fiber are exposed. Such a pattern section may even have holes in the denim fabric.

The sandblasting process for local and global abrasion may use sandblasting equipment to abrade the denim jeans with sand particles or other abrasive media. This process blasts sand particles from a sandblasting device to a pair of jeans. The random spatial distribution of the sand creates a special appearance in a treated area that is referred to as "feathered". The abrasion in the feathered area varies from light along the perimeter of the pattern, e.g., the edges and top of the pattern, to heavy in the center of the pattern. This unique appearance may simulate the look of denim jeans that have been worn for a considerable time.

However, the sandblast process has a number of problems and limitations. For example, the process of blasting sand or other abrasive media presents environmental and health issues. Typically, a worker needs to wear protective gear and masks to reduce the impact of inhaling airborne sand. The job is considered to be a hazardous job, and may cause high employee turnover.

The individual skill of the operator may also be critical in reducing the scrap rate associated with the sandblast process. This has the additional effect of increasing certain costs of labor for the sandblast operator which are typically higher than the labor rate for other employees in the denim finishing plant, since their skill may be important. The actual blasting process may occur in a room which is shielded from other areas in the manufacturing facility.

Further environmental issues arise with the cleanup and disposal of the sand.

The sandblasting process is an abrasive process, which causes wear to the sandblasting equipment. Often, the equipment needs to be replaced on a yearly basis or even more frequently. This, of course, can result in added capital, maintenance and installation expense.

Also, new designs such as shadow effects along the top or bottom of the whisker are difficult to impossible to obtain with the conventional sandblasting processes.

All in all, the sandblasting process may cost in excess of $1.00 per pair of jeans, due to the cost of labor, materials, and scrap produced, and environmental clean up required. It is difficult to duplicate the exact placement of the sandblast pattern from one garment to the next due to the variability of the process itself and the variability from one laborer to another.

The sandblast process can also adversely affect the tear and tensile properties of the denim jeans due to the abrasion of the sand on the denim. It is not uncommon for the sandblast process to reduce the tear and tensile strength of the denim by as much as 50%. Further, the tear and tensile strength variation following sandblasting is high due to the uncontrollability of the abrasive process. Some manufacturers even need to test the tear and tensile properties of the denim at specific locations where the abrasion is the least to even pass the apparel company standards for tear and tensile strength.

Other approaches to creating worn looks present their own problems. In the case of whiskers or frayed looks, manufacturers may rely upon very labor intensive, expensive and slow hand rubbing or sanding processes where the whiskers or frayed looks are applied to the denim by hand sanding, sometimes with a rotating drill such as a DREMEL™ tool. In addition to the labor costs associated with such a process, this hand sanding operation is often associated with defects after washing, where the sanding of the individual whiskers on the denim may be too little or too much resulting in a low quality product. Some manufacturers have even tried to use robotic sanding processes to avoid these problems, albeit at considerable capital investment and limited flexibility.

Despite the above shortcomings, sandblasting and rubbing processes remain in wide use because the market desires worn look denim.

The present assignee has disclosed laser processing of denim, e.g. in U.S. Pat. Nos. 5,990,444; 6,002,099 and 5,916,961. These techniques enable using a laser to change the look of a textile product.

SUMMARY

In recognition of the above, the inventors propose new laser scribing devices and techniques to simulate specified worn looks on fabrics and garments.

One aspect includes using a laser to scribe lines on a garment, where the energy density per unit time of the laser causes the garment to change color to varying degrees from indigo blue or black to white or grey. Both the individual scanned lines and different sections of a lazed pattern can have washing, where the sanding of the individual whiskers on the denim may be too little or too much resulting in a low quality product. Some manufacturers have even tried to use robotic sanding processes to avoid these problems, albeit at considerable capital investment and limited flexibility.

Despite the above shortcomings, sandblasting and rubbing processes remain in wide use because the market desires worn look denim.

The present assignee has disclosed laser processing of denim, e.g. in U.S. Pat. Nos. 5,990,444; 6,002,099 and 5,916,961. These techniques enable using a laser to change the look of a textile product.

SUMMARY

In recognition of the above, the inventors propose new laser scribing devices and techniques to simulate specified worn looks on fabrics and garments.

One aspect includes using a laser to scribe lines on a garment, where the energy density per unit time of the laser causes the garment to change color to varying degrees from indigo blue or black to white or grey. Both the individual scanned lines and different sections of a lazed pattern can have varied energy density per unit time. The variation in energy density per unit time can be controlled by changing the power, speed, distance, or duty cycle of the laser as the lines are scribed on the material.

Other aspects are also disclosed.

BRIEF DESCRIPTION OF THE DRAWINGS

These and other aspects will now be described in detail with respect to the accompanying drawings, wherein.

DETAILED DESCRIPTION

Figure 1:
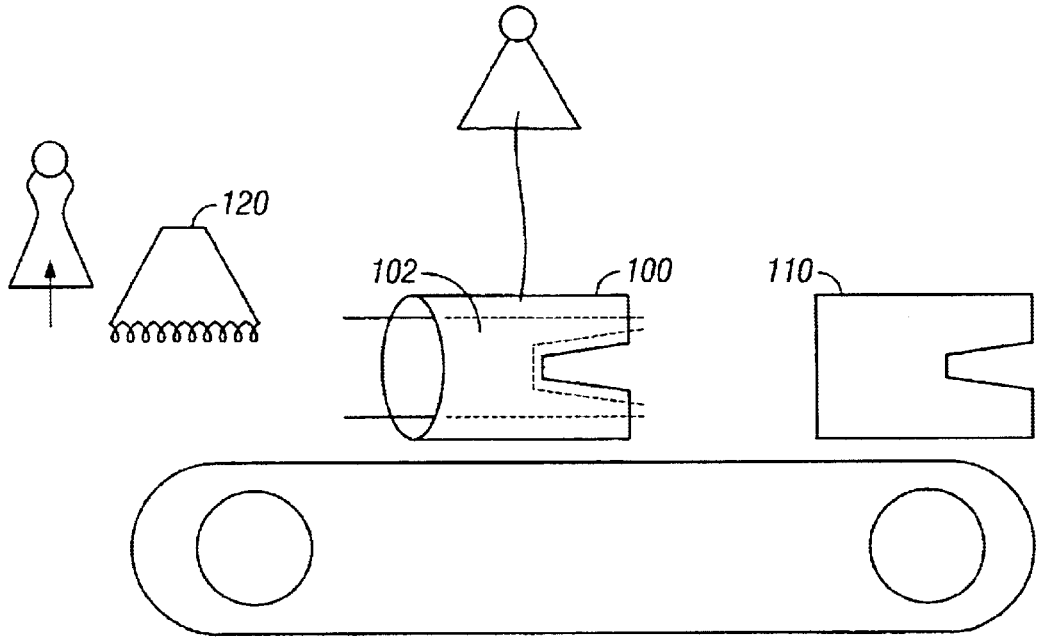
FIG. 1 shows an overall lasing system.

The described system and method teaches a system for producing worn looks on textile materials and/or garments that are made from these textile materials. These worn looks can include abrasion effects which simulate the look of a worn garment, whisker effects, frayed effects, as well as any other effect which is produced on a garment or another product made from a textile material and which makes the textile material look more like a used textile material. In addition, entirely new looks are possible from this invention that cannot be reproduced from the conventional sandblasting or rubbing process. This is done using a number of techniques described in detail herein.

A first technique uses a laser. The output of the laser is caused to move across a textile material. The applied energy from the laser changes the look of the textile material without undesirably burning, punching through or otherwise harming the textile material. The basic operations of applying energy from a laser are described in U.S. Pat. No. 5,990,444.

In the disclosed system, the effective applied energy of the laser, e.g, the energy density per unit time ("EDPUT") of the laser, is changed while the laser is scribing a line across the material ("on the fly"). The line which is scribed can be a straight line or a waveform of any shape; however, a line is formed by the laser traversing the textile or garment from one edge to another.

The present application introduces the concept of effective applied energy. This includes the amount of energy that is effectively applied to an area of a material. That area can be any size or shape. The "effective applied energy" can include edput, but also includes changing scan line speed, power level or speed level or duty cycle level of the laser. It includes change the distance of the laser to the material, which can defocus the laser, and thereby change the EDPUT. It also includes effective applied power being applied in multiple sessions or times, by applying multiple passes, e.g. of fixed power etc. The effect is to apply more energy to some areas than to others.

Another element produces a control sequence that simulates a statistically random property of particle distribution such as would be produced by a sandblasting process. This technique is used with a user interface program, which enables the designer to paint the information on an interface screen. The image on the screen is applied to the material with a laser. Another aspect of the technique enables use of a much higher power laser than previous systems of this type.

As described above, the amount of change that the laser produces on the textile material is based in part on the effective applied energy to the material; previously described in U.S. Pat. No. 5,990,444 as the energy density per unit time level of the laser relative to the material. EDPUT depends on power of the laser, spot size and scan speed of the laser system relative to the material.

A laser output of the laser is used to scribe multiple lines across the material. The line can repeat, i.e. in a zigzag or triangle wave shape. According to the present system, the EDPUT level is changed while a line is being scanned across the material. That is, at some point between the ends of at least one scan line, the EDPUT is different than it is at either end of the line. The controller system controls the change of EDPUT level by controlling the parameters which control EDPUT (power or duty cycle or speed or distance).

The EDPUT delivered to the material may be changed in different ways. A first way is to change the wattage or power of the laser output in a continuous or discontinuous fashion. A laser relies on light bouncing back and forth inside a laser cavity. The level of excitation of the laser itself may be variable in certain lasers. Hence excitation unit 200 may actually be variable to vary the power output of the laser. Thus, this first way to change the EDPUT level of the laser directly controls the level of excitation of the laser in an analog manner.

The other EDPUT controls do not change the actual laser power output, but instead change the effective amount of energy density per time that arrives on the material. Another control of EDPUT is via duty cycle control. The control drive 198 to the excitation unit 200 can be cycled between on, and off, at a relatively quick rate. The rate of turning on and off must be fast relative to the movement of the laser. This technique changes the duty cycle of the output of the laser 205, effectively controlling the laser to deliver a different average power level. In any short time, i.e. in the amount of time it takes the laser to traverse a distance equal to one or two times the width of the laser beam, the duty cycle may be adjusted multiple times. The effective applied energy density per unit time may therefore be adjusted by this system, since the root mean square of the power varies with time just as if the power were changed itself.

The laser can also use an adjustable shutter, as shown as element 210. This shutter may use a fast piezoelectric element to open and close an aperture through which the laser beam 208 passes. The mechanical shutter can also turn on and off the shutter relatively quickly. Hence, this mechanical shutter forms an alternate way of changing the duty cycle of laser application.

The laser beam is applied to the garment and caused to move relative to the garment by a laser moving element 215. This laser moving element can include moving mirrors, or some other way of changing the laser movement. In this embodiment, the controller may also produce an output that controls the scanning speed of the laser. By changing the speed of the laser, the EDPUT changes along the course of its line, even if the output power of the laser stays constant.

Figure 2:
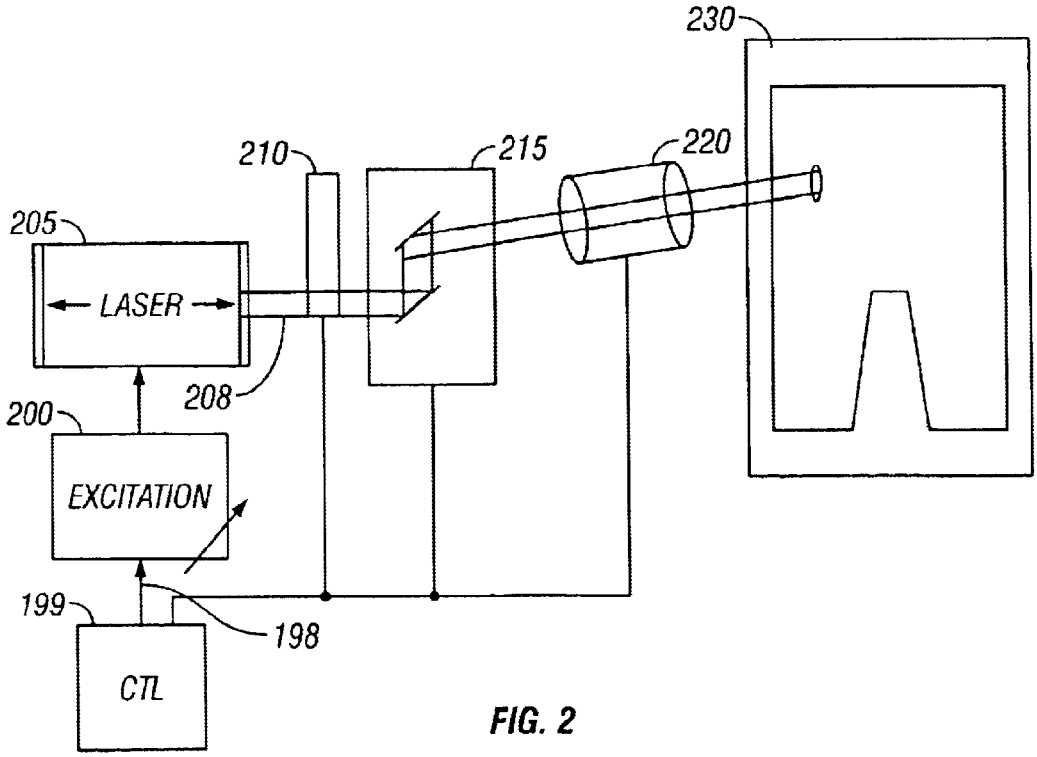
FIG. 2 shows a controllable laser system.

Yet another way of changing the EDPUT is via changing the output size of the laser beam. FIG. 2 shows a zoom lens assembly 120 which is electrically controllable. The controller 199 may produce an output signal that changes the relative position of the lenses to one another and thereby electrically changes the spot size.

Alternatively, the platform 230 holding the material may itself be moved. Placing the garment on a curved surface is yet another way to change the EDPUT levels by intentionally causing the laser beam to come out of focus (lowering the EDPUT) at the curved sections if the center of the section is exactly in focus.

Yet another way to change the EDPUT is to make multiple passes or laser scans on different segments of the pattern. Those sections which have multiple passes will have higher effective EDPUTs if all other laser operating parameters are held constant.

This system is used to attempt to mimic naturally-occurring processes. Worn looks that are obtained from a conventional laser scribing process may look overly uniform in some circumstances. This may be referred to as a contrived or pasted look. The goal, however, is to produce as natural a look as possible.

U.S. Pat. No. 5,916,461 describes using a probability density function to randomly turn the laser on and off to simulate "feathering" on the material.

The inventors recognized, however, that continuously and discontinuously changing the EDPUT level within any laser scan line can even further improve the effect. By so doing, this system alters the amount of change or abrasion to the textile material, as the laser scribes individual lines on the textile material. This invention provides complete control of the degree of feathering. The degree of feathering can be continuously controlled then by changing the EDPUT levels anywhere in the pattern. Control of feathering in this way can achieve a worn looks that appears authentic.

One aspect of this system, therefore, produces a worn look or other desired look on a textile material by scanning a laser across a textile, and uses the laser to change a color of the material, where the effective power density per unit time of the laser is changed at least once within a scan line.

According to one aspect, typically sandblasted garments are examined. This examination reveals different shapes and wear patterns. These patterns are basically non-uniform in nature. A high degree of feathering, or variation of the material (abrasion), across the edges and top and bottom of a pattern is observed, either directly by a human examiner, or via an automated examination process. Different concentrations of wear along different areas of the pattern are also observed. The present system stores information from this observation in the memory 195 that is associated with the controller. This information includes geometric information about the wear pattern to be scribed. The information also includes the look of the actual scanned portion.

This look is then translated into an specified type of parameter matrix. The matrix can be an EDPUT matrix, a power matrix, a duty cycle matrix or a speed-matrix, for example. The inventors have found by experimentation that the amount of energy per unit time that is applied to any specific area of certain textiles may change the look in proportion to the applied amount of energy. This proportion need not be a linear proportion. The look change may also include the look after washing.

Different patterns can hence be scanned, e.g. using a scanner or camera. The scanner can evaluate each of the sections on the garment, here shown as denim jeans. The system may evaluate, using the total resolution of the scanner, the color of that section. A look up table can be established relating the color of certain materials to the applied EDPUT or power or duty cycle or speed or distance. In this way, the EDPUT for each area on the jeans can be established.

This information can be used to form the above-described matrix, storing any of the above-described parameters. This matrix can then be used as the information in the memory 195 which drives the controller to drive the laser. In this way, different EDPUT levels can be applied to different sections of the textile based on the information that is obtained by observing some other material.

Alternately, the user can examine the wear pattern and manually enter the changes in EDPUT (power, speed, duty cycle or distance) that are associated with the change in abrasion along the pattern geometry. These techniques can replicate any desired look, and can also produce an entirely new look.

In another aspect, existing looks can be edited. The look is scanned as noted above to form a matrix. The matrix can then be edited to keep the desirable parts, and change other parts.

Examples of the distribution of EDPUT along a single scanned line may look as shown in Table I.

TABLE I

EDPUT Calculations for a Scanned Line

| | Power (watts) | Spot (mm) | Area (mm2) | Speed mm/sec | EDPUT watts-sec/mm3 |
|---|---|---|---|---|---|
| Scan #1: | | | | | |
| Start of Scan | 150 | 0.30 | 0.0707 | 25,000 | 0.08 |
| First Section of Scan | 190 | 0.30 | 0.0707 | 25,000 | 0.11 |
| First Quarter of Scan | 225 | 0.30 | 0.0707 | 25,000 | 0.13 |
| Second Quarter of Scan | 250 | 0.30 | 0.0707 | 25,000 | 0.14 |
| Middle of Scan | 250 | 0.30 | 0.0707 | 25,000 | 0.14 |
| Third Quarter of Scan | 225 | 0.30 | 0.0707 | 25,000 | 0.13 |
| Fourth Quarter of Scan | 190 | 0.30 | 0.0707 | 25,000 | 0.11 |
| End of Scan | 150 | 0.30 | 0.0707 | 25,000 | 0.14 |
| Scan #2: | | | | | |
| Start of Scan | 50 | 0.30 | 0.0707 | 50,000 | 0.01 |
| First Section of Scan | 500 | 0.30 | 0.0707 | 50,000 | 0.14 |
| First Quarter of Scan | 800 | 0.30 | 0.0707 | 50,000 | 0.22 |
| Second Quarter of Scan | 1000 | 0.30 | 0.0707 | 50,000 | 0.28 |
| Middle of Scan | 1000 | 0.30 | 0.0707 | 50,000 | 0.28 |
| Third Quarter of Scan | 800 | 0.30 | 0.0707 | 50,000 | 0.22 |
| Fourth Quarter of Scan | 500 | 0.30 | 0.0707 | 50,000 | 0.14 |
| End of Scan | 300 | 0.30 | 0.0707 | 50,000 | 0.08 |
| Scan #3: | | | | | |
| Start of Scan | 50 | 0.30 | 0.0707 | 10,000 | 0.07 |
| First Section of Scan | 300 | 0.30 | 0.0707 | 10,000 | 0.42 |
| First Quarter of Scan | 500 | 0.30 | 0.0707 | 10,000 | 0.71 |
| Second Quarter of Scan | 1000 | 0.30 | 0.0707 | 10,000 | 1.41 |
| Middle of Scan | 1000 | 0.30 | 0.0707 | 10,000 | 1.41 |
| Third Quarter of Scan | 500 | 0.30 | 0.0707 | 10,000 | 0.71 |
| Fourth Quarter of Scan | 300 | 0.30 | 0.0707 | 10,000 | 0.42 |
| End of Scan | 50 | 0.30 | 0.0707 | 10,000 | 0.07 |

This table shows that the EDPUT varies from about 0.08 watts-sec/mm$^3$ to about 0.14 watts-sec/mm$^3$ for the first scan line which may produce local abrasion patterns. The EDPUT varies from about 0.01 watts-sec/mm$^3$ to about 0.28 watts-sec/mm$^3$ for the second scan line which may produce somewhat different local abrasion patterns. The EDPUT varies from about 0.07 watts-sec/mm$^3$ to about 1.4 watts-sec/mm$^3$ for the third scan line. These latter, higher EDPUTs may be associated with more aggressive abrasion patterns including fraying. However, it should be seen that within a certain scanned line, the EDPUT value can vary 40% or so and yet within another line, the EDPUT may vary by over 1000%. Of course, the EDPUT values can vary as little as 25% or as much as 2000% to create different worn looks with different degrees of feathering.

In general, looking at these values, the EDPUT can increase by any desired amount. Moreover, while this system shows the EDPUT changing a few times within a scan, the EDPUT can change any number of times within a scan line. The EDPUT control is thus infinite and can vary a few percent to several thousand percent along each scanned line and from one scanned line to another.

The inventors observed that the cycle time to laze the abraded pattern on denim legs could be reduced to 8 seconds or less at a scan speed of 50,000 mm/sec by using higher power or duty cycle to maintain the intensity of the image.

Table II shows the variation in EDPUT along an individual scanned line for a different pattern.

TABLE II

EDPUT Calculations for Worn Pattern #2

| | Power (watts) | Spot (mm) | Area (mm2) | Speed mm/sec | EDPUT watts-sec/mm3 |
|---|---|---|---|---|---|
| Worn Pattern #2: | | | | | |
| Start of Scan | 20 | 0.30 | 0.0707 | 10000 | 0.03 |
| First Section of Scan | 50 | 0.30 | 0.0707 | 10000 | 0.07 |
| First Quarter of Scan | 500 | 0.30 | 0.0707 | 10000 | 0.71 |
| Second Quarter of Scan | 500 | 0.30 | 0.0707 | 10000 | 0.71 |
| Middle of Scan | 500 | 0.30 | 0.0707 | 10000 | 0.71 |
| Third Quarter of Scan | 300 | 0.30 | 0.0707 | 10000 | 0.42 |
| Fourth Quarter of Scan | 150 | 0.30 | 0.0707 | 10000 | 0.21 |
| End of Scan | 20 | 0.30 | 0.0707 | 10000 | 0.03 |
| Worn Pattern #2: | | | | | |
| Start of Scan | 20 | 0.30 | 0.0707 | 20000 | 0.01 |
| First Section of Scan | 50 | 0.30 | 0.0707 | 20000 | 0.04 |
| First Quarter of Scan | 500 | 0.30 | 0.0707 | 20000 | 0.35 |
| Second Quarter of Scan | 500 | 0.30 | 0.0707 | 20000 | 0.35 |
| Middle of Scan | 500 | 0.30 | 0.0707 | 20000 | 0.35 |
| Third Quarter of Scan | 300 | 0.30 | 0.0707 | 20000 | 0.21 |
| Fourth Quarter of Scan | 150 | 0.30 | 0.0707 | 20000 | 0.11 |
| End of Scan | 20 | 0.30 | 0.0707 | 20000 | 0.01 |
| Worn Pattern #2: | | | | | |
| Start of Scan | 20 | 0.30 | 0.0707 | 50000 | 0.01 |
| First Section of Scan | 50 | 0.30 | 0.0707 | 50000 | 0.01 |
| First Quarter of Scan | 500 | 0.30 | 0.0707 | 50000 | 0.14 |
| Second Quarter of Scan | 500 | 0.30 | 0.0707 | 50000 | 0.14 |
| Middle of Scan | 500 | 0.30 | 0.0707 | 50000 | 0.14 |
| Third Quarter of Scan | 300 | 0.30 | 0.0707 | 50000 | 0.08 |
| Fourth Quarter of Scan | 150 | 0.30 | 0.0707 | 50000 | 0.04 |
| End of Scan | 20 | 0.30 | 0.0707 | 50000 | 0.01 |

The inventors realized that having the ability to vary EDPUT or power or duty cycle along each individual scanned line provides advantages of superior control of the degree of feathering, and hence, the creation of an almost infinite variety of worn looks. Further, the EDPUT or power or duty cycle could change both along each individual scanned line as well as from scanned line to scanned line. EDPUT distributions such as shown in Tables III–IV could easily be achieved, along with almost any other EDPUT distributions that are specified.

Table III shows a non-uniform pattern with somewhat symmetrical shape along the center, whereas Table IV shows a non-uniform pattern with heavier applications of power in the lower left quadrant of the pattern. Hence, a greater variety of EDPUT patterns and thus worn looks can be created with these techniques.

TABLE III

EDPUT (watts-sec/mm3) Matrix for Worn Pattern #3

| | X Position (mm) | | | | | | |
|---|---|---|---|---|---|---|---|
| Y Position (mm) | 0 | 5 | 10 | 15 | 20 | 25 | 30 |
| 0 | 0.05 | 0.1 | 0.2 | 0.3 | 0.1 | 0.08 | 0.02 |
| 10 | 0.1 | 0.3 | 0.5 | 0.5 | 0.2 | 0.1 | 0.03 |
| 20 | 0.2 | 0.4 | 0.7 | 0.7 | 0.3 | 0.2 | 0.1 |
| 30 | 0.4 | 0.6 | 0.7 | 0.7 | 0.4 | 0.3 | 0.1 |
| 40 | 0.4 | 0.5 | 0.7 | 0.7 | 0.3 | 0.3 | 0.1 |
| 50 | 0.3 | 0.4 | 0.7 | 0.6 | 0.2 | 0.1 | 0.05 |
| 60 | 0.2 | 0.3 | 0.4 | 0.5 | 0.1 | 0.1 | 0.03 |
| 70 | 0.1 | 0.2 | 0.3 | 0.4 | 0.05 | 0.05 | 0.02 |
| 80 | 0.05 | 0.1 | 0.2 | 0.3 | 0.05 | 0.03 | 0.01 |

TABLE IV

EDPUT (watts-sec/mm3) Matrix for Worn Pattern #4

| | X Position (mm) | | | | | | |
|---|---|---|---|---|---|---|---|
| Y Position (mm) | 0 | 5 | 10 | 15 | 20 | 25 | 30 |
| 0 | 0.01 | 0.03 | 0.05 | 0.1 | 0.2 | 0.2 | 0.05 |
| 10 | 0.01 | 0.03 | 0.1 | 0.3 | 0.3 | 0.2 | 0.025 |
| 20 | 0.05 | 0.4 | 0.7 | 0.6 | 0.6 | 0.5 | 0.09 |
| 30 | 0.05 | 0.5 | 0.7 | 0.6 | 0.4 | 0.3 | 0.1 |
| 40 | 0.1 | 0.7 | 0.7 | 0.5 | 0.4 | 0.3 | 0.1 |
| 50 | 0.2 | 0.7 | 0.7 | 0.6 | 0.6 | 0.3 | 0.05 |
| 60 | 0.1 | 0.6 | 0.6 | 0.3 | 0.5 | 0.1 | 0.03 |
| 70 | 0.01 | 0.05 | 0.1 | 0.5 | 0.4 | 0.05 | 0.02 |

This revolutionary concept changes the "black and white" characteristic of the laser-scribed image to a new "gray-scale" characteristic. In the conventional laser marking of materials such as wood, plastic, metals, etc. the image is created at a constant EDPUT or power or duty cycle. In the case of laser marking denim, as described in the inventors earlier patents noted above, the image may be created by using a constant EDPUT on each line. Thus, one uniform color was formed after lazing and washing that was between indigo blue or black (for low EDPUT scribing) and white or gray (for high EDPUT scribing). However, the capability to continuously or discontinuously change the EDPUT allows the image to assume any shade (after washing) between indigo blue and white, along any section of the pattern. The shade is associated with the degree of abrasion or degree of wear. Hence, the ability to control the shade also allows control of the degree of abrasion and feathering.

Further, this new flexibility can thus allow for the creation of entirely new looks not possible by any other economic means. Worn looks, images, or entirely new looks with sections of continuously or discontinuously different shades between white and indigo blue can be created. The techniques of continuously or discontinuously changing the EDPUT during laser scribing as described herein may have other applications in other material industries where lasers are used to mark materials such as wood, glass, plastic, rubber, fabric, steel and others.

As alluded to above, this system has the ability to more accurately assess worn looks. This is done by producing a control sequence which replicates the desired properties; in an on/off manner, continuous manner, discontinuous manner or in an analog manner. Any desired amount of control can be provided, limited only by the amount of EDPUT gradations produced by the system. The general EDPUT profile can still be specified ha graphically, but the precise point during the scribing of a line at which EDPUT will change can also be controlled. The EDPUT profile can include a percent of the highest power or duty cycle required. As an example, 50% values may be chosen for areas requiring light abrasion and 100% values can be chosen for areas requiring heavy abrasion.

A new technique which assists the apparel designer, is disclosed. This allows the operator to paint the desired shape or geometry of the pattern desired to be lazed on the denim to obtain the worn look on the computer screen. In addition, the designer specifies the degree of feathering or EDPUT or power or duty cycle profile. Again, this specification can simply be a percent of the maximum EDPUT, power or duty cycle.

Each level of effective applied power is associated with a color. Different sections of the pattern are painted with different color contents, where the color contents can be in full power, e.g., R,G,B levels or in gray scale levels. In one embodiment, the colors are associated with different levels of duty cycle control of the laser. The user draws on the computer screen, with the mouse, the desired shape of the pattern. Then the user can select different colors for different areas. This can use a point-and-shoot technique or selection from a menu or by right clicking on an area and selecting from a context menu. This click associates different sections of the pattern with different EDPUT/power/duty cycle levels. The actual power level or duty cycle associated with a given color may be set by a user, and may be modified for different materials.

Figure 3:
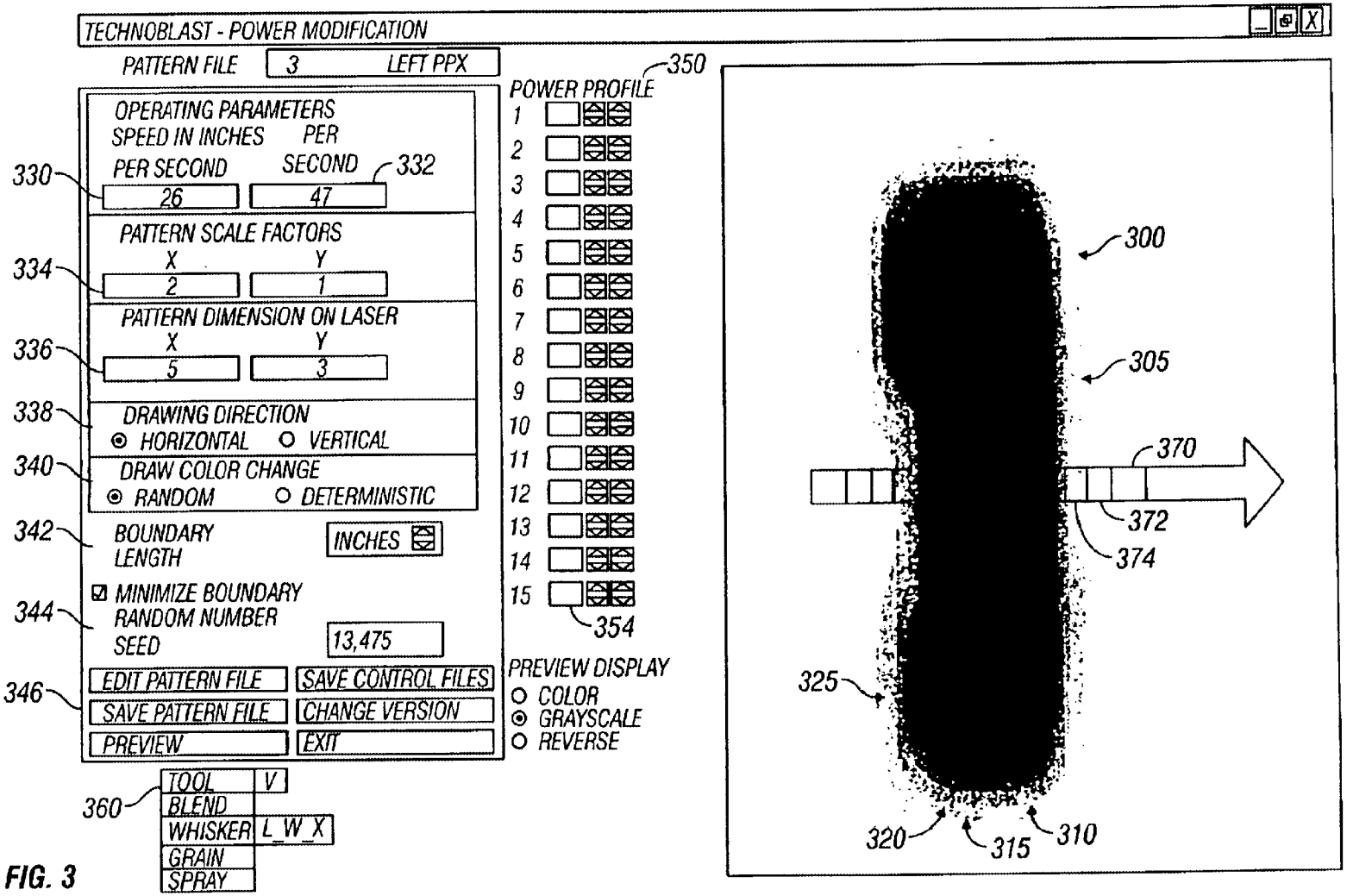
FIG. 3 shows a control screen for a specified worn look.

A local abrasion effect can be produced using the user interface screen shown in FIG. 3. FIG. 3 shows a graphical user interface which permits formation of a pattern, or a portion of a pattern which will form the basic design to be scribed on a garment. The actual pattern 300 is formed of a plurality of different sections. The outer section 305 defines the overall outer perimeter of the shape. Also within the sections are other perimeters shown as 310, 315, 320 and the like. The innermost shapes, such as 325, are also shown. For shapes of this type, where the patterns define an oval pattern, many of the sections are concentric or semi-concentric. The sections can be defined by perimeters. Spaces between each two perimeters defines a section. Alternatively, each section can define a separate layer.

FIG. 3 also shows a plurality of operating parameters which can be set. This includes 330, which sets the speed in inches per second and 332 which sets the laser scale factor in units per inch. The pattern scale factor 334 can also be set. The pattern dimension on the laser can be set. 338 indicates the drawing direction of the laser. 340 represents the color change. A boundary length is set in 342. For some random or psuedo random processes, a random seed may be necessary. This random seed may be set. Typical editing controls, such as edit, save, preview, etc. are also shown.

350 represents the power profile. The colors 352 are on the left side, and the power profile in row 354 is associated with that color.

The system starts with the user selecting a section, either the outermost section or any of the more inner sections that are shown. Each of these sections can be set as having a specified power profile by associating a color from the color palette 352 with a section. The power profiles represent different laser intensities (EDPUT levels) and thus different degrees of wear. For example, the lighter outer sections such as 310 and 305 may be associated with a lower power duty cycle level. This creates a more lightly worn look. The darker sections of the pattern, such as the section 325, may be associated with higher power duty cycles and represent a more heavier worn look. 325 might represent the part of the pattern that is drawn at the knee section. Different shades of gray (following washing of the garment) are shown in the areas between the two extremes. These areas represent colors of the pattern section that is between indigo blue and total white after the processing by the laser and washing of the garment. Each of these changes are displayed in color. The values can be saved in either grayscale or in full color and are stored as part of the pattern file, here shown as left.ppx.

The pattern file represents the power profile information for the specified pattern which is displayed and editable via the user interface.

Additional processing features are also used to give the pattern a more realistic look. A tool set, shown as 360, can be selected to carry out these functions. A first tool which is described herein is the blend function. Blend can be carried out either pixel by pixel, or area by area. The specific area which is blended may be selectable. A blend computes an average color for each pixel or area by forming a weighted average of the color of the pixel or area and the color of neighboring pixels or areas, e.g. eight neighboring pixels or areas. The number of pixels forming the weights can be varied to achieve various outcomes.

Another tool, shown herein as the whisker tool, may aid in whisker generation. Users may set the length and angle of the whisker, and then automatically produce a whisker pattern which can be later edited by the user.

A "grain" tool is shown as part of 360 which produces a "grainy" look. The process for the grainy look gives each pixel, and its neighboring pixels, a color vote. The weight for each vote depends on how long the pixel has maintained the specified color. The terminology of "long" can refer to number of units of image in an area, for example. Again, while this system refers to colors, it should be understood that gray scales can also be used to view the separated sections. The sections can also be marked with other area delimiters, such as hatching, stipling or the like.

Another tool developed as part of this invention is a "blaster" tool. In a manner similar to that used by the "spray can" tool supplied with many computer drawing programs to "spray" a specific color, the blaster tool sprays "incremental intensity" onto the pattern. To continue with the analogy, every time a "droplet" from the spray can hits the drawing surface, the pixel or area that is hit adopts the color being sprayed. With the blaster tool, a pixel hit by a droplet of incremental intensity has its color level incremented to the next higher level. The effect of the tool produces an effect whose impact is dependent on an amount of time spent "blasting" a given region. A longer period of blasting causes more pixels to be colored with the effect and hence causes a greater impact.

The blaster tool can also be used in an intensity-removing mode. In this mode, pixels that are hit have their color level changed to the next lower intensity level.

Any pattern that is formed by natural wear can be accurately simulated through the use of the blaster tool.

Furthermore, this tool can be automated to draw certain common features automatically, for example, a curved line simulating a whisker, a pocket wear pattern and the ladder pattern that appears along the seams of worn jeans.

An "undo" function allows one or many functions to be reversed if the user does not like the effect. This can, for example, allow trying different sprays or other effects to test if a good result is obtained. If not, the operation is reversed. This system can produce a number of different effects. Communication of pattern parameters from the design computer to the laser control computer may be used to develop an efficient system. Many formats have been developed for computer viewing, generation and transmission of graphic images. The format for these files may allow for a higher degree of image complexity (e.g., color) than required for the present purpose and therefore tend to provide more information and details than is needed for the present purposes.

A new file format has been developed called TBF (TechnoBlast Format) which communicates precisely those parameters required for converting the desired image into laser control commands.

The file in the "TBF" format may be a bit-mapped format of a matrix. Each value represents power level/duty cycle/EDPUT for each pixel in the image as well as other control values. This file format therefore includes an edput value, or at least a value indicative of the amount of effective energy to be applied to a pixel associated with each pixel or group of pixels that is handled as a unit.

Since the information can be stored on a pixel by pixel level, the writing laser can write in either the horizontal or the vertical direction, or in any other direction for that matter, based on the same information. The direction of writing can be selected by the drawing direction 38. Assuming the writing is in the horizontal direction, the image is sliced into pixel-wide fragments. The slice 370 shows, in exaggerated form, one of these pixel wide fragments. It should be understood, however, that these pixels are not drawn to scale, and that in fact a real pixel could be of any desired size. Note that each pixel such as 372, 374 may have a different EDPUT level associated with it. The EDPUT level is changed as the laser is scanning from pixel to pixel.

Many different kinds of looks can be produced using this system. The following describes only examples of these looks. It should be understood that other effects could easily be produced. Any of these looks can be obtained in any of the ways described herein, i.e., by authoring a special image intended for use in changing the color of textile fabric, or by scanning a real garment and using the results of the scan to form information to use in changing the color.

Figure 4:
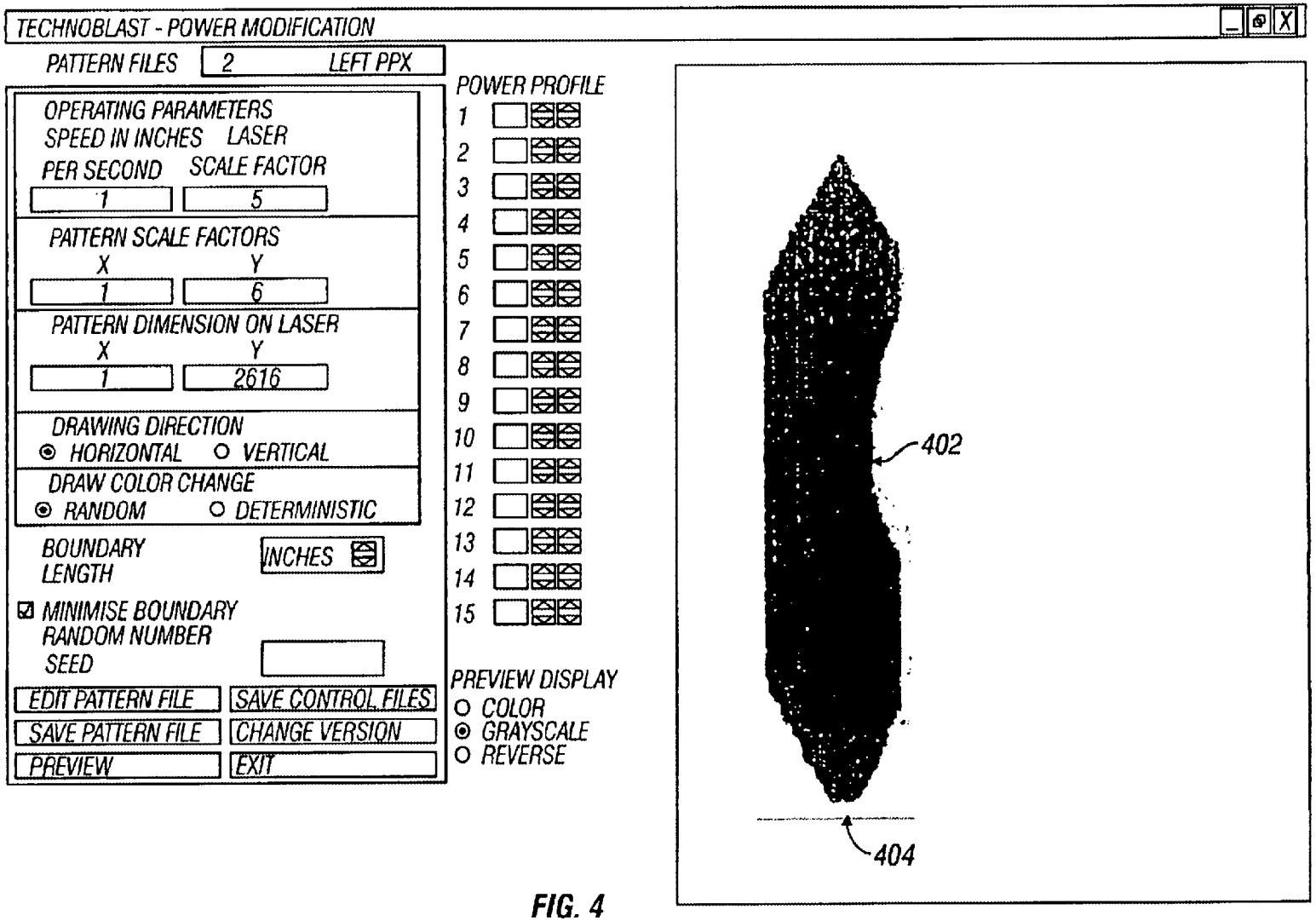
FIGS. 4-12 show control screens for different specified worn looks.

FIG. 4 shows a localized worn look which extends from somewhat below the waistband to the somewhat below the knee on each denim leg. The color of the worn look (after washing) varies from white or gray in the intense areas of the knee shown as 402 to black or blue indigo (less intense areas) along the top, bottom and side portions of the knee shown as 404.

Figure 5:
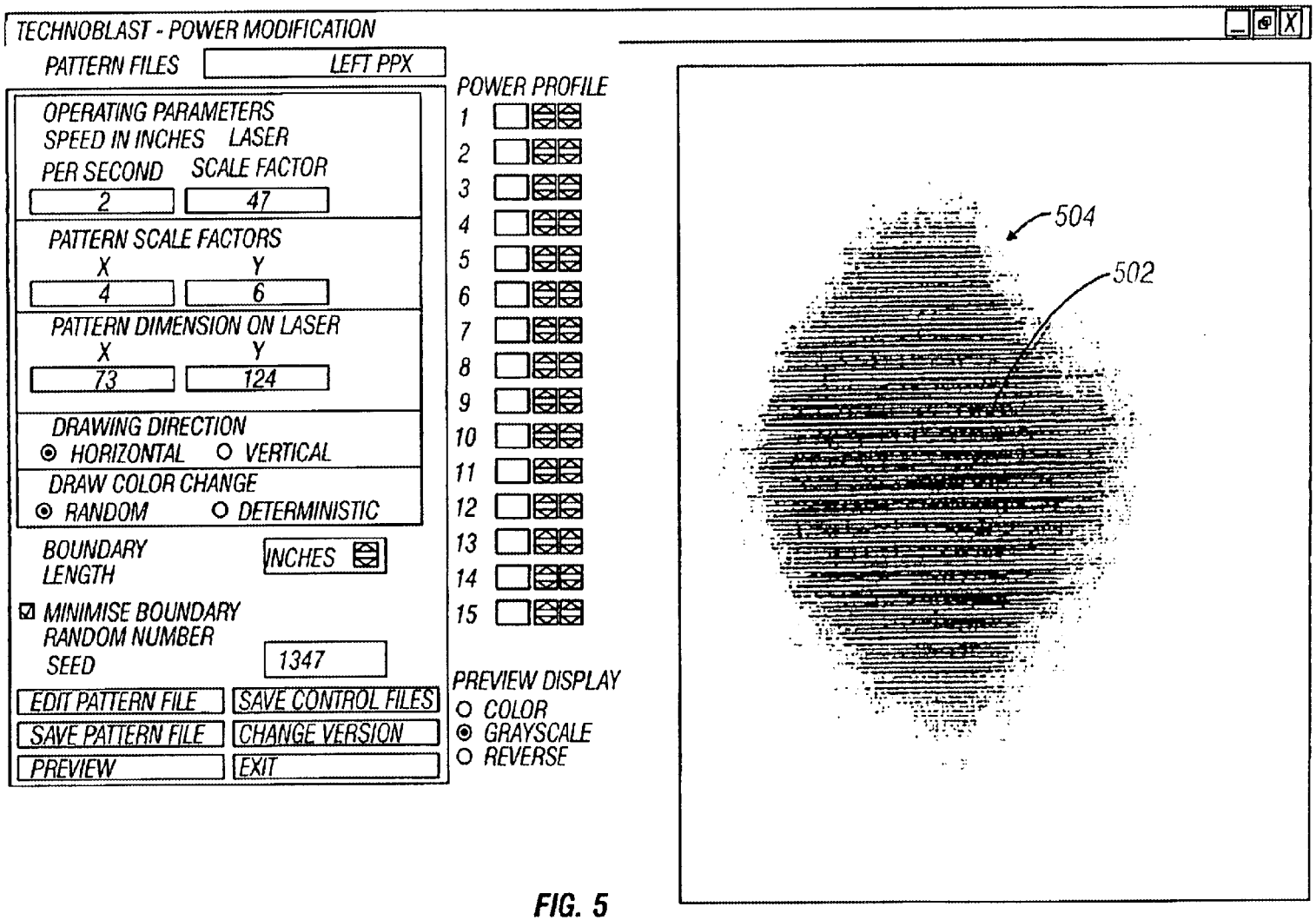

FIG. 5 shows an alternative look which is intended for use in the rear portion of the denim, e.g. in the seat area. Again, this portion is substantially oval shaped, but has some worn portions in the center 502 and less worn portions towards the edge 504.

Figure 6:
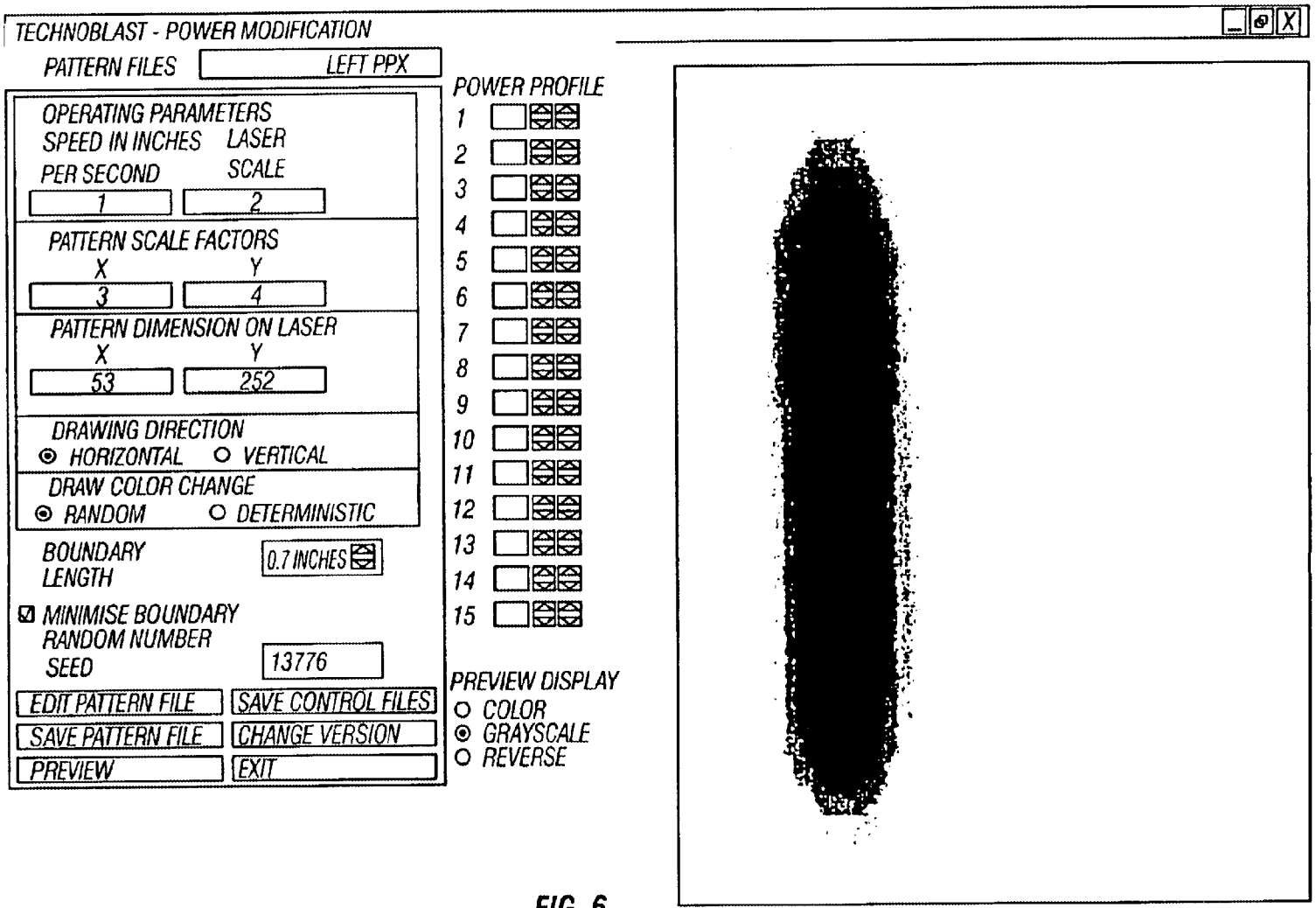

FIG. 6 shows a global worn look from the waistband to the end of the leg section where the color of the worn look (after washing) ranges from white or gray in the intense areas along the center and length of the pattern to indigo blue or black along the top, bottom and edges of the pattern.

FIG. 6 also shows the global worn look from the rear waistband to the end of the leg section, where the color of the worn look changes from white or gray in the intense areas of the pattern to indigo blue or black along the top, bottom and edges of the pattern.

Figure 7:
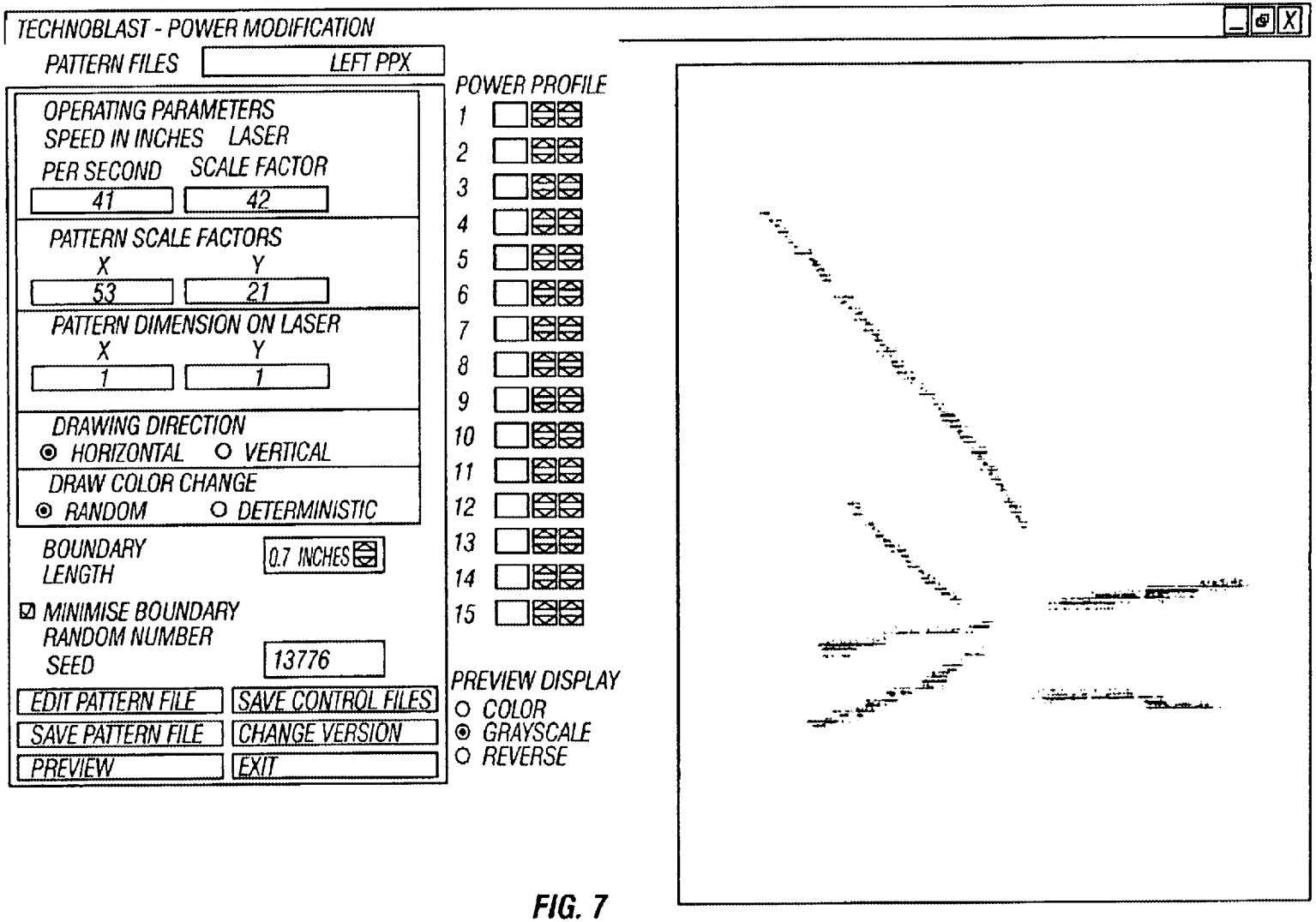
Figure 8:
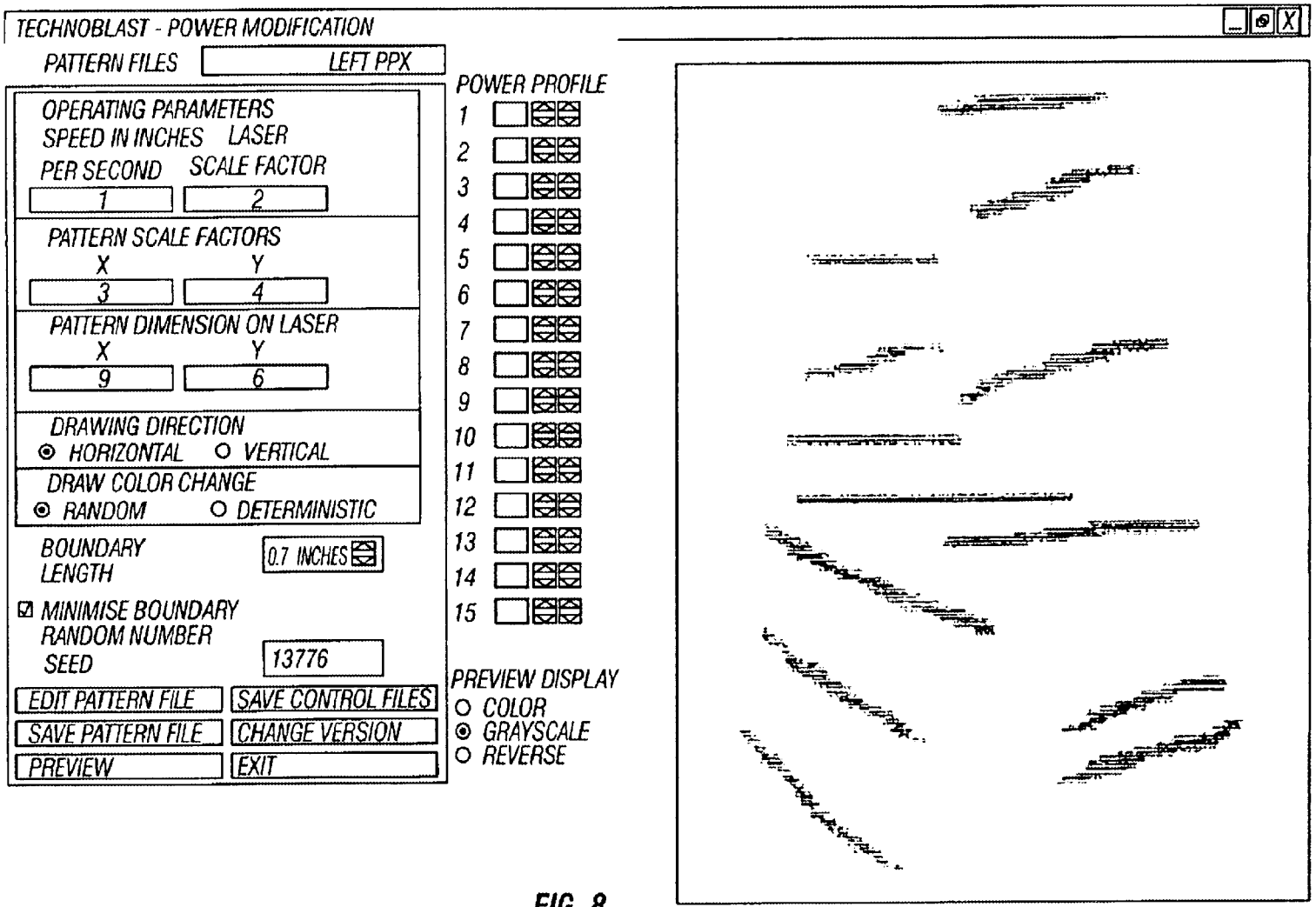

FIGS. 7 and 8 show a whisker worn look with multiple lines from about ⅛ inch to about 2 inches in width by 1 to 14 inches in length. The color of the pattern changes from white or gray in the center of the pattern to indigo blue or black along the edges of the pattern. The whisker worn look can be along any area of the front and back of the denim jeans and may contain one or several rectangular sections.

Figure 9:
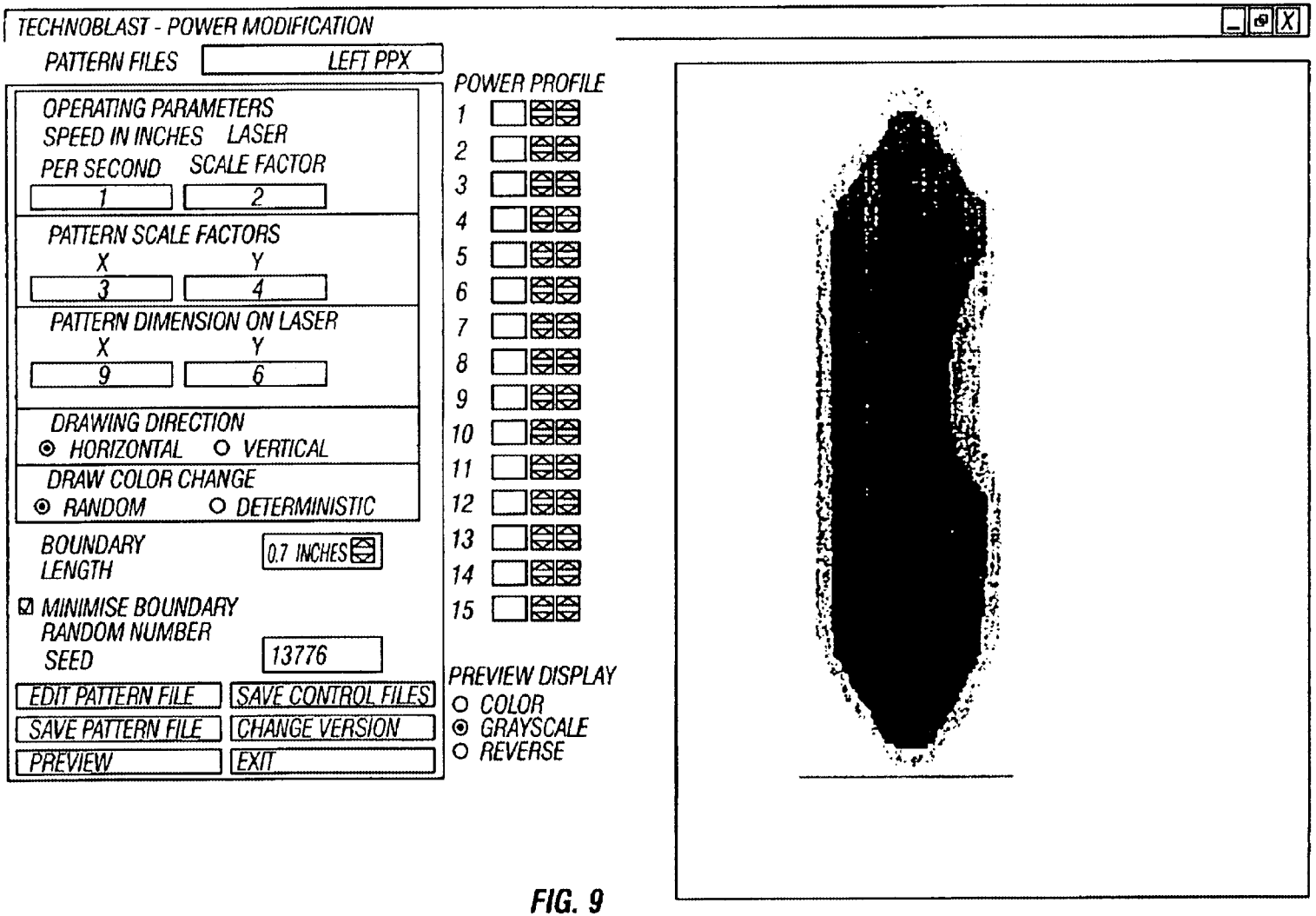
Figure 10:
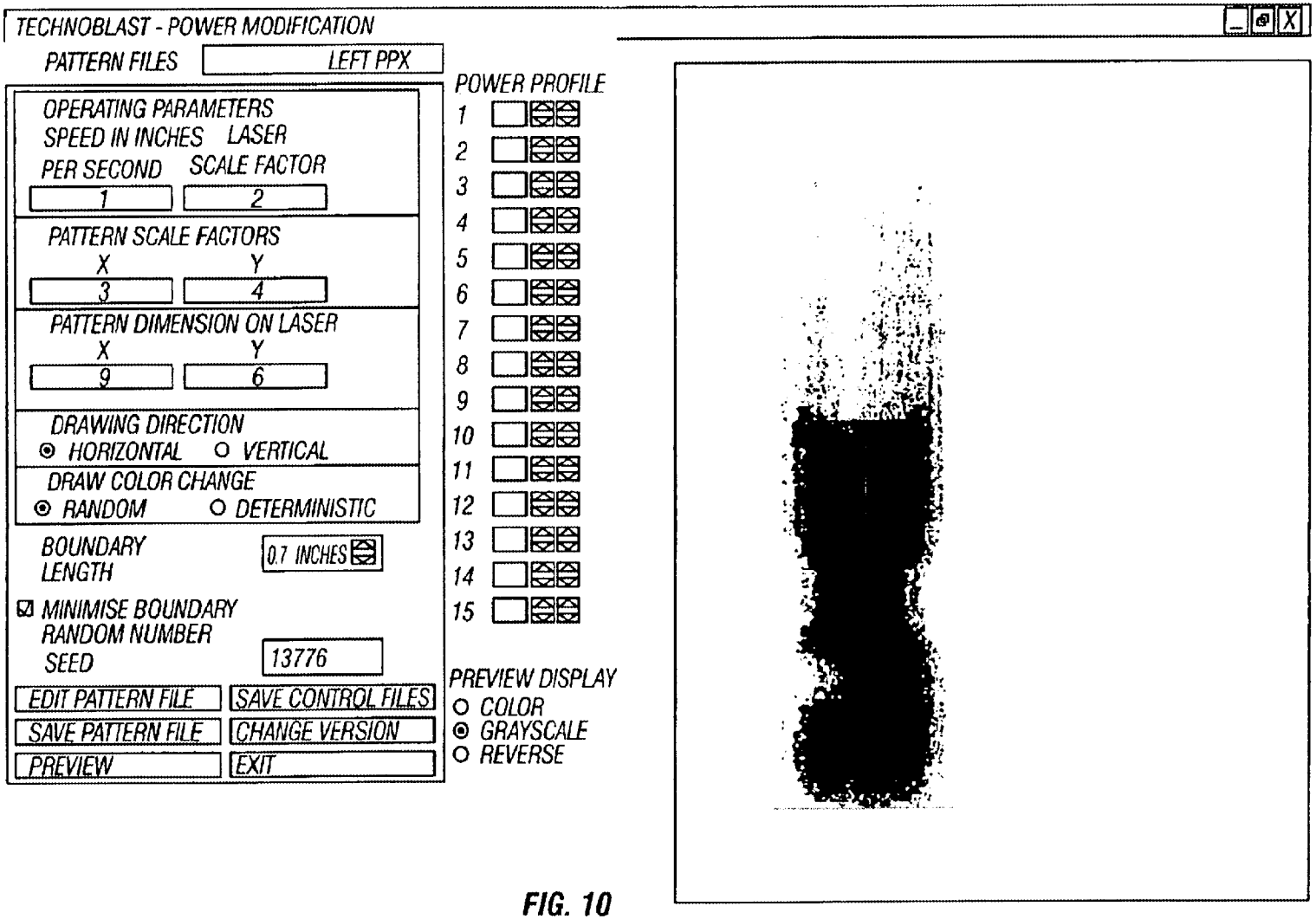

A frayed look in the knee, rear seating area, along the bottom of the front and back leg section or any other area of the denim jean is shown in FIGS. 9–10. The EDPUT is of sufficient magnitude to fray the denim so that individual threads are exposed or actual holes are provided in the denim.

This goes against the teaching in the above '444 patent, which teaches that punch through of the material is undesired. The specific "fraying" effect, provides enough EDPUT to intentionally cause damage to the material, however in a controllable and desired fashion.

Figure 11:
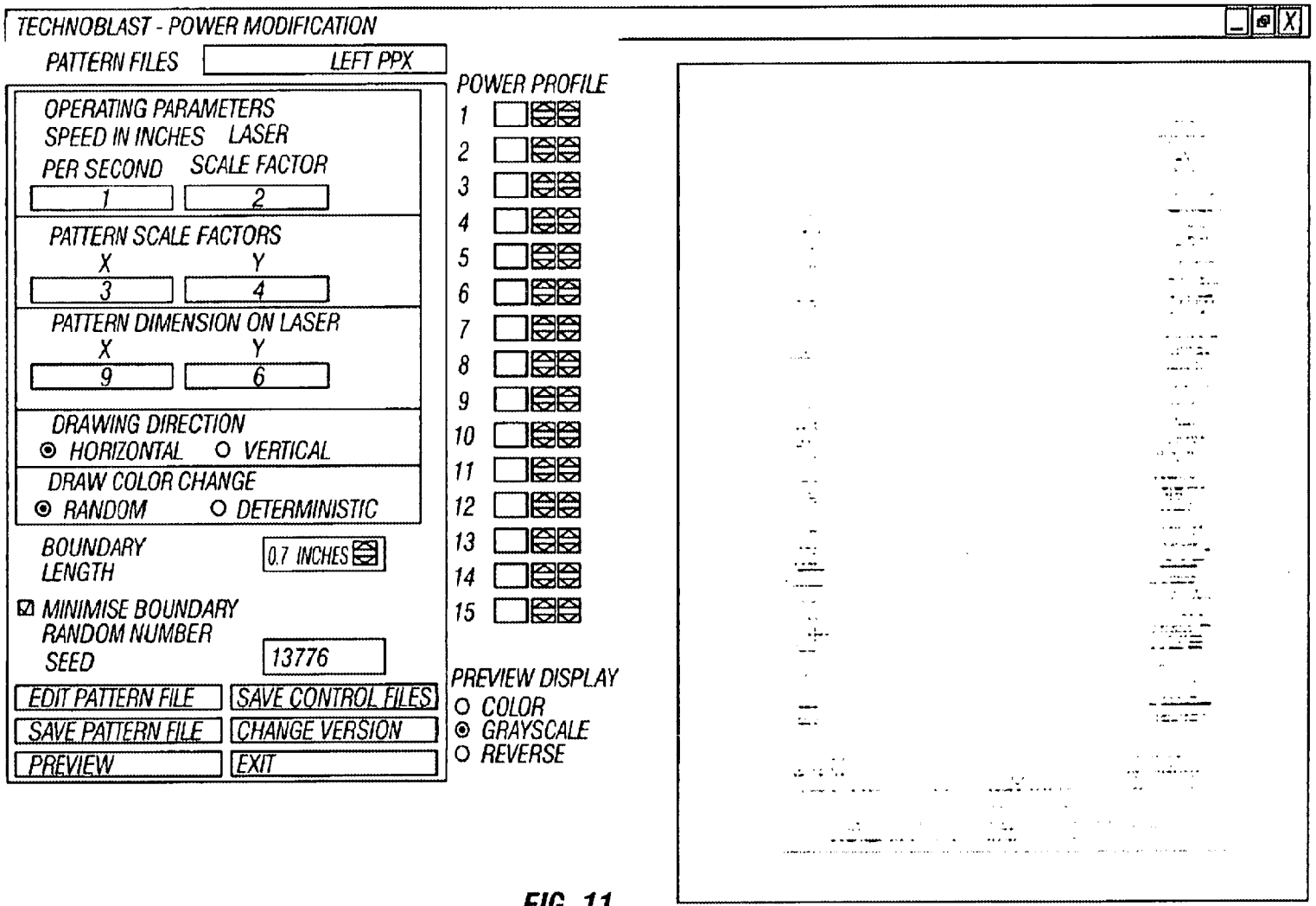

A rectangular worn pattern of about 2 inches by 4 inches along the rear pocket of the denim is used to simulate the wear from a wallet in the back pocket, where the color of the pattern is white or gray along the periphery of the rectangle and indigo, blue or black in the center. FIG. 11 shows the TechnoBlast pattern image created for this type of look.

Figure 12:
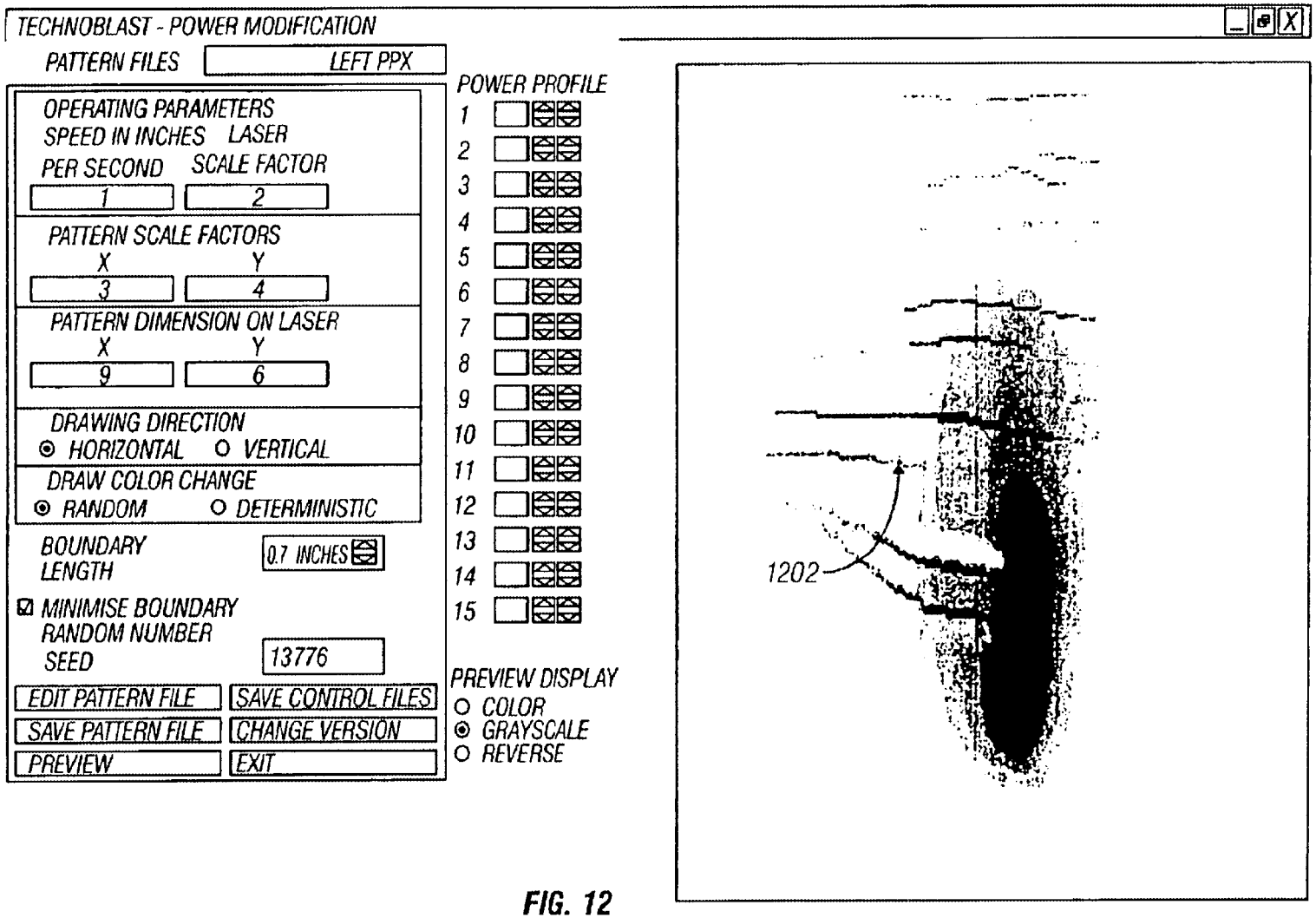

Any or all of these looks may be combined into a single image. The composite image may then be used to laze denim jeans. This may represent an additional benefit of this system. In previous systems, different processes were used to obtain different effects. For example, conventional sandblasting is used to produce local abrasion on front and back denim leg sections. Whiskers are made using a hand sanding operation where individual laborers produced the various whisker patterns. Frayed looks use hand sanding drills and the like. In this system, however, multiple effects can all be included within the same file. For example, FIG. 12 shows a composite file including a plurality of the effects shown above. An additional effect, in which the whiskers are shadowed, is shown as 1202 in FIG. 12. Just above or below the whisker, a section is colored white. This indicates no lazing in that section such that after washing the area is denim blue. The whisker itself can be different colors to produce different feathering effects. This technique produces a shadowed effect for the whiskers considered quite desirable.

Previous systems of this type have used relatively low power lasers, e.g. from 25 to 100 watts, of the type intended for marking materials. Marking lasers have been used to form graphic images and text on plastic, wood, steel and glass. Another kind of laser, called the laser cutter, typically produces much higher powers, e.g. 250 to 2500 watts. One problem noted by the inventors is the cycle time for applying the worn pattern. When the low power lasers have been used, the cycle time may be on the order of minutes for each application.

The present application describes the use of a much higher power laser, e.g. a laser having a power level of 250 watts or higher, even more preferably 500 watts or higher, and most preferably 1000 watts or higher. For example, a cycle time for abrading denim jeans can be minutes with a 50 watt laser that is typically used for marking. A 500 watt laser can produce the same pattern in a few seconds. This 500 watt laser has typically only been used for cutting operations, however. The expectation is that these higher power lasers would unintentionally damage the material. However, by adjusting the EDPUT, higher power lasers can safely be used.

As a specific example, the inventors were able to use the 500 watt lasers to laze abrasion patterns on the front and rear sections in 15 seconds as compared with two minutes for the sand blasting process. Using 2500 watt lasers for the application area is also contemplated, which will decrese the cycle time even further.

Additional developments were made during initial trials with high-powered lasers. One noted problem is that the desired level of power or duty cycle at the beginning of the scribing of a line can be higher than requested, here called an overshoot. The physical nature of the laser process requires that when changing from a lower level of power or duty cycle to a higher level of power or duty cycle, "inertia" of the power may cause the power or duty cycle to initially overshoot the desired higher power or duty cycle. This may cause an initial excess visible impact on the denim target. This effect may be strongest when the laser is actually turned from off (zero power) to on. The effect on denim becomes much more evident when higher power lasers are used, e.g. 500 watts or higher.

To overcome this problem, a boundary solution is used. The desired pattern is given a "boundary" area. The laser power is set to a level x that is as high as possible without causing any visible effect on the denim or other garment material. The laser output is brought to a position outside the boundary. Since the laser is at the power level x, this causes no visible change. When the laser beam enters the region of desired visible impact, the effective power level is increased. The effective power level is increased less at that time, since the increase is from x to the desired level, rather than from 0 to the desired level. Overshoot from initial turn on may be reduced in this way.

Another important feature noted by the present application is based on the interference based on the pattern/lines that are scribed by the laser, and the direction of the materials stitch lines. Certain undesirable "interference patterns" may be produced by the interaction between the laser writing properties, the frequency of the laser and the directional properties of the material. These directional properties can include any aspect of the material that is asymmetric—and specifically can include cut, fill and twill of the denim fabric. A rotation of the fabric or the scribing direction may change this effect. Orienting the material such that the scan line makes a 90 degree angle with the cut, fill or twill minimizes the effect, when it is desired to minimize that effect. However, some of the interference patterns themselves produced quite interesting looks for denim jeans, and may be desirable. Hence, one aspect of this system includes taking into account the effects of the interaction between the laser scanning and the directional properties of the material.

Hence, another parameter of this system requires the directional pattern of the material to be placed in a specified orientation. This can also be controlled by changing the drawing direction using control 338. One other aspect uses a camera vision system pointed to face the material and to automatically detect the directional properties of the material. Those properties are then input into the computer, and used as one parameter of operation.

As mentioned previously, it is highly desirable to avoid an artificial or contrived look when attempting to simulate natural wear. It is therefore useful to minimize the opportunity for the human eye to perceive any regularity in the pattern produced by the laser. One approach to achieving this is to allow the user to specify the power levels in the design, but to cause the precise point at which power changes between two adjacent levels to be determined at random. This feature may not always be desirable. Hence, randomization of power level change is a user selectable option.

The higher power lasers can operate faster, and therefore benefit from more automated processes. The conveyer system shown in FIG. 1 provides the denim jeans 100 over some form 102. The denim jeans are introduced to the laser in a horizontal direction. The laser then scribes the worn look, after which a second pair of jeans shown as 110 are maintained behind it and also introduced for subsequent processing. After processing a batch of jeans in this manner, they can be removed from the form and reversed to either the same or different laser to scribe the worn look on the rear. FIG. 1 also shows an in-line material processing system, including an inline-laundry device 120, e.g, a system that applies shampoo with a brush, and a removal system, such as a wet vac 130. This can use components from commercially available rug cleaning systems, e.g. a rug doctors or similar shampoo/vacuum combination can produce a desired effect with an in line system.

FIG. 1 shows a straight path conveyer system. However, a carousel type conveyor is contemplated.

Figure 13:
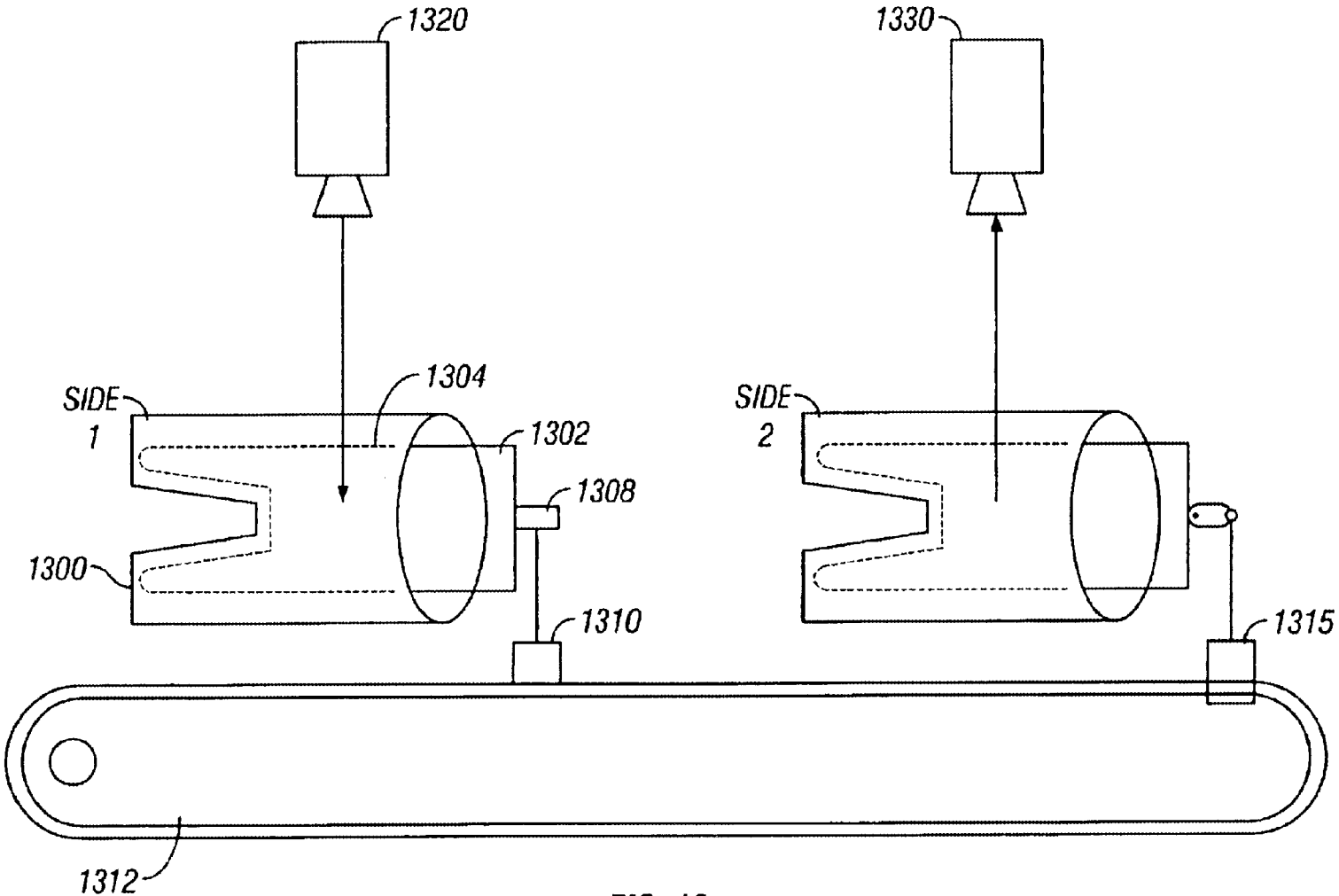
FIG. 13 shows a material delivery system with automatic turnover.

An alternative system is shown in FIG. 13. The jeans 1300 are located on a form shown as 1302. The form holds the jeans in some way e.g. using clips on the inside shown as 1304, 1306. These clips hold the denim jeans in place on the form. Each of the forms also include a rotation rod 1308 connected to a rotator 1310. The jeans are conveyed along the conveyer 1312, which includes at least two of these rotators, the second one being shown as 1315. At a first location, the jeans come into contact with a first laser 1320. This laser produces the worn look on the front of the jeans shown as side 1. After so doing, the rotator 1308 is lifted up and causes the jeans to be flipped to side 2. Subsequently, side 2 comes into contact with the second laser 1330 which scribes the rear worn look. The jeans are removed from the form after processing, and a new pair of unprocessed jeans applied to the form. While this system describes using two lasers, it should be understood that a single laser could be used, i.e. by scribing the front side of one or multiple pair of jeans, and later flipping all the jeans and scribing the other side. An automated system can detect whether the front or back is being presented, e.g. by imaging the garment to look for the label or bar code on the jeans. A camera vision system can key in on a specific area of the jean such as the waistband each time and simply adjust the laser scan to insure proper placement of the image on the denim each time.

Figure 14:
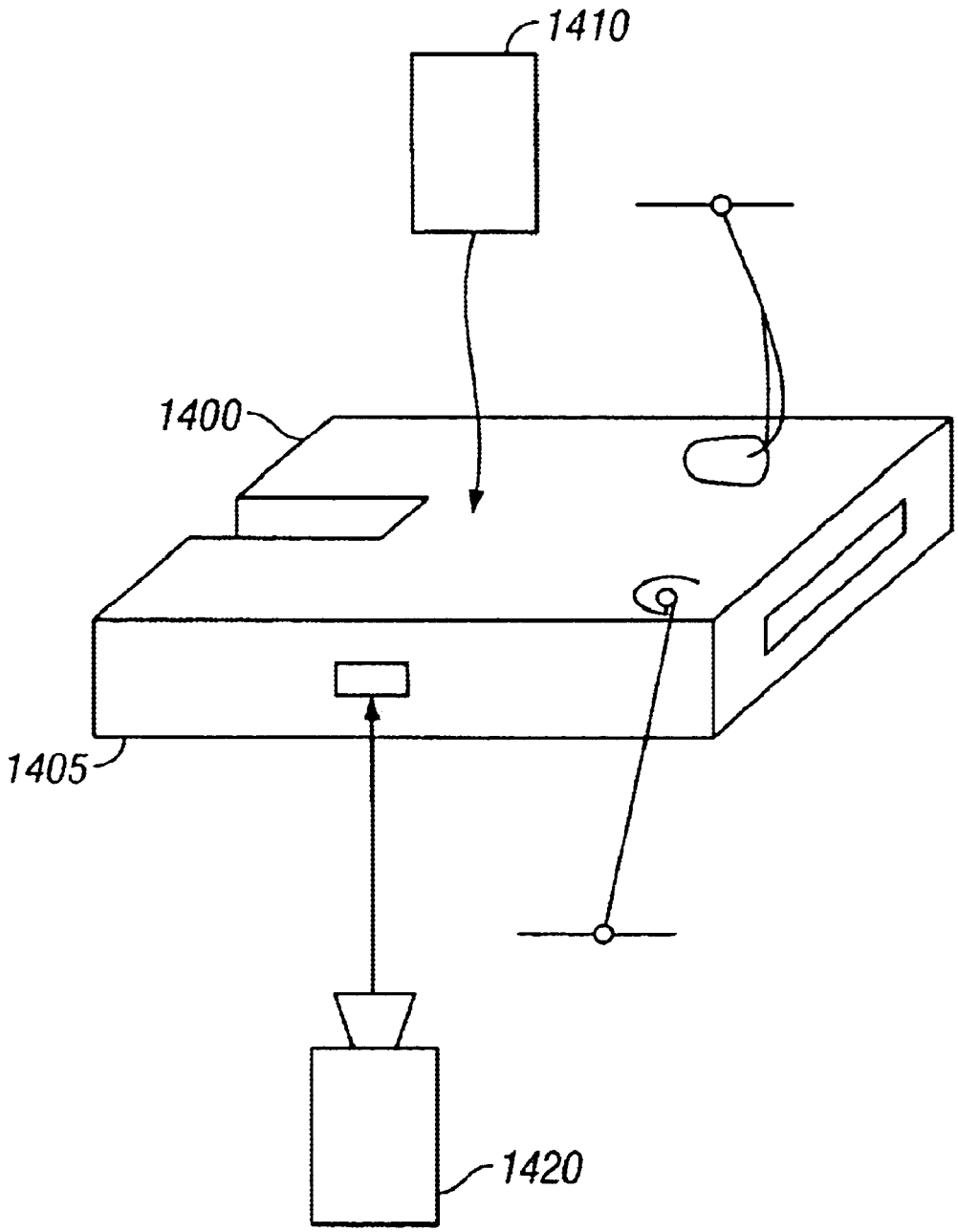
FIG. 14 shows a material delivery system with a dual sided laser.

FIG. 14 shows yet another system. The jeans are held from their sides by clipping on a clip area to a specified location, e.g. the inside of the pocket where minimal denim processing will take place. Other clip areas are also possible. The materials processing system carries the denim by the clip areas, e.g. by a wire which is constantly moving.

Alternately, a form of the type shown in FIG. 13 can be used as free standing conveyer system. In this embodiment, dual lasers are used, with one on the top scribing the worn look on the top surface 1400 of the jeans and the other laser 1420 on the bottom, scribing the worn look on the bottom surface of the jeans 1405. Any free standing conveyer system can be used for this. For example, this may also be done with the garment suspended on a hanging system in the vertical direction. Different form shapes are also possible.

Different type of worn looks may be obtained depending upon the type of form that is used. For example, typical metal forms such as used in the dry cleaning industry produce a worn look that is similar to that obtained from sandblasting, since the garment is relatively flat as the laser scribes the worn look on the garment. However, using an inflatable balloon type form, such as used in some denim finishing plants, produces a somewhat different worn look. The balloon is inflated inside the denim pant leg, causing the fibers to be spread. The jean wraps around the form in a concave fashion during scribing.

The inventors noted that this invention produced benefits in the production of denim jeans with whisker patterns to simulate the creases along the thigh and knee section. Denim manufacturers have tried numerous methods to create the desired whisker patterns. Many have noted that only the hand sanding process was really acceptable to create the authentic worn look for the whiskers. This process may be labor intensive and the quality of the whisker pattern is a function of the skill of the laborer who sands the whiskers on the denim. Considerable variability exists from one laborer to another, as would be expected. Some laborers apply too much pressure and some too little pressure such that the quality of the end product is quite variable.

However, the inventors noted that using the new technique of changing the EDPUT along the individual scribed lines, any desired whisker pattern could be exactly replicated. Further, a typical whisker pattern could be applied to the denim jeans with this invention in a few seconds, compared to several minutes with the hand sanding operation. The quality of the whisker pattern produced from this system is consistent from one denim jean to the other because of the consistency of the laser scribing process. Hence, the yield would be expected to be significantly greater with this invention compared with the hand sanding operation.

Although only a few embodiments are disclosed, other modifications are possible and are intended to be encompassed within the following claims. For example, other marking elements, that is other marking elements besides a laser, are contemplated.

What is claimed is:

1. A method comprising:

storing information about effective applied power levels for a plurality of scan lines of a laser element, at least a plurality of said scan lines having levels of effective applied power which change within a single scan line; and using a laser to process a material by controlling scan lines of the laser to have a controlled energy density per unit time which depends on said effective applied power levels.

2. A method as in claim 1 wherein at least a plurality of said effective applied power levels are values which do not undesirably damage a material.

3. A method as in claim 2 wherein at least a plurality of said effective applied power levels are values which intentionally cause a hole in the material to cause fraying.

4. A method as in claim 2 wherein said material is a denim garment.

5. A method as in claim 1 wherein said information is indicative of a simulated abrasion effect to create a worn look.

6. A method as in claim 1 wherein said information is indicative of simulated whisker effect.

7. A method as in claim 1 wherein at least part of said information is indicative of a simulated fraying effect.

8. A method as in claim 1 wherein said laser has an output power of 500 watts or greater.

9. A method as in claim 1 wherein said laser is one which has an output power of 1000 watts or greater.

10. A method as in claim 1 wherein said information represents an oval shaped pattern.

11. A method as in claim 1 wherein said control of effective applied power levels is carried out by control of duty cycle of said laser thereby controlling an effect of amount of power delivered by the laser in a pulsed manner.

12. A method as in claim 11 wherein said control of duty cycle comprises turning a laser on and off at specified rate.

13. A method as in claim 12 wherein said specified rate is fast relative to the movement of the laser.

14. A method as in claim 11 wherein said control of duty cycle comprises selectively blocking and unblocking an output of the laser to thereby control an effective amount of power delivered by the laser.

15. A method as in claim 1 further comprising changing the EDPUT by changing a speed of movement of the laser.

16. A method as in claim 1 wherein said change of effective applied power levels comprises changing an output size of a laser beam that is output from the laser.

17. A method as in claim 1 further comprising feathering an edge of the pattern by changing a power level of the image at said edge to form a more gradual change of effect at said edge.

18. A method as in claim 1, wherein said information is in a specified format, which includes an indication of an area and an indication of an effective applied power level to be applied to said area.

19. A method as in claim 1, wherein said effective applied energy is one of an energy density per unit time, power level of a laser, a duty cycle of an output of a laser, a speed of movement of a laser, or a distance of a laser.

20. An apparatus, comprising:

a computer controlled laser, having an output which impinges on a surface to be modified by said laser and which is controlled according to a computer file, said computer controlled laser producing said output beam having a controlled effective applied power level of application to the area, according to said computer file, wherein said computer file includes at least a plurality of scan lines in which said effective applied power level changes within a single scan line at least three times to at least three different values.

21. An apparatus as in claim 20 wherein said laser has a power output of 500 watts or greater.

22. An apparatus as in claim 20 wherein said laser has a power output of 1000 watts or greater.

23. An apparatus as in claim 20 wherein said effective applied power level is selected for a specific textile material to be lazed, and at least one of said effective applied power levels in said computer file changes the look of the textile material without undesirably burning, punching through or otherwise harming the textile material.

24. An apparatus as in claim 23 where at least one of the effective applied power levels in said computer file does cause burn through of the material to expose fibers in the material.

25. An apparatus as in claim 23 further comprising an in-line shampooing element, which provides a shampooing operation and a shampoo removal operation to a garment which has been lased by the laser.

26. An apparatus as in claim 20 wherein an effective applied power level of the laser is changed by turning on and off the laser at a specified duty cycle.

27. An apparatus as in claim 20 further comprising an adjustable shutter which modulates an output of the laser, and a control element which turns on and off said shutter, based on said computer file, to adjust said effective applied power level.

28. An apparatus as in claim 27 wherein said shutter is a piezoelectric element.

29. An apparatus as in claim 27 wherein said shutter is a mechanical shutter.

30. An apparatus as in claim 20 wherein said effective applied power level changes to at least five different values in at least a plurality of scan lines of said laser.

31. An apparatus as in claim 20 wherein said effective applied power level changes between a lowest value and a highest value, wherein said highest value is at least 125% of said lowest value.

32. An apparatus as in claim 20 wherein said effective applied power level changes between a lowest value and a highest value, wherein said highest value is at least twice said lowest value.

33. An apparatus as in claim 20 wherein said file represents a pattern which includes a feathering portion at an edge of the pattern where a change in effective applied power level is made gradual to gradually change an effect thereof.

34. An apparatus as in claim 20 further comprising a control console, having a user interface, said user interface graphically showing a pattern which is to be lased, said pattern including differently highlighted areas for different effective applied power levels.

35. An apparatus as in claim 34 wherein said differently highlighted areas comprise different colors.

36. An apparatus as in claim 35 further comprising a look up table which stores a relationship between an effect to a material, and a duty cycle of operation of the laser to provide said effect.

37. An apparatus as in claim 35 further comprising an editing tool which enables editing said pattern.

38. An apparatus as in claim 34 wherein said differently highlighted areas comprise different gray scales.

39. An apparatus as in claim 20, wherein said computer file includes a plurality of information parts, each information part associated with a specific area on an image representing a garment to be altered, and each information part including information indicating effective applied power level information for a laser.

40. An apparatus as in claim 20 wherein said file stores a pattern of a simulated worn pattern.

41. An apparatus as in claim 20 wherein said file represents a pattern which stores a simulated whisker pattern.

42. An apparatus as in claim 20 wherein said file represents a pattern which stores a pattern with a hole through the denim of a type which exposes fibers of the denim.

43. An apparatus as in claim 20, wherein said effective applied energy is one of an energy density per unit time, power level of a laser, a duty cycle of an output of a laser, a speed of movement of a laser, or a distance of a laser.

44. An apparatus comprising:

a controllable laser, which is controllable by a computer file, to produce an output on a desired area, said laser having a maximum output power which is 500 watts or greater; and said computer file storing control information which adjusts a duty cycle of an output of said laser to control an effective applied energy applied to said area to a desired amount and providing said information for a desired energy density per unit time to said controllable laser for said area.

45. An apparatus as in claim 44 wherein said laser is controlled to scan in lines, and wherein a plurality of said lines have different effective applied area at one area than in another area.

46. An apparatus as in claim 45 wherein said effective applied energy changes to at least three different values within a single scan line.

47. An apparatus as in claim 44 wherein at least some of said effective applied energies is set to a specific value relative to a material in said area, which changes the abrasion or color of said material without undesirably damaging the material.

48. An apparatus as in claim 44 where at least part of said effective applied energies provides a desired punch through effect in said material.

49. An apparatus as in claim 44 further comprising a terminal, which provides an image of a simulated pattern to be applied to the material, said image having differently indiciaed areas to represent different effective applied energies.

50. An apparatus as in claim 49 wherein said indiciaed areas comprise differently colored areas.

51. An apparatus as in claim 49 wherein said indiciaed areas comprise different grayscales.

52. An apparatus as in claim 49 wherein the simulated pattern has a plurality of concentric oval areas.

53. An apparatus as in claim 44 further comprising a duty cycle controller comprising and on off control for the laser.

54. An apparatus as in claim 44 further comprising a duty cycle controller comprising a shutter, selectively opened and closed at an output of the laser.

55. An apparatus as in claim 44, wherein said effective applied energy is one of an energy density per unit time, power level of a laser, a duty cycle of an output of a laser, a speed of movement of a laser, or a distance of a laser.

56. A method, comprising:

defining a desired pattern of color alterations to be formed to a garment by selecting a plurality of areas on a display, defining a color that is associated with each of a plurality of abrasion levels, selecting a color to associate with each of the plurality of areas to thereby associate a level of abrasion with each of the plurality of areas; and storing a computer file indicative of said selecting.

57. A method as in claim 56 further comprising enabling said display to be edited, to change color and or shape.

58. A method as in claim 57 wherein said computer file specifies information for use in forming control data for a laser to scribe lines on a desired garment, wherein at least a plurality of said lines specify an energy density per unit time which changes within a single scan line.

59. A method as in claim 58 wherein at least a plurality of lines have an energy density per unit time which has at least three values within the specified line.

60. A method as in claim 59 wherein a highest of said three values is at least 1.25 times as high as a lowest of said three values.

61. A method as in claim 57 wherein said editing comprises applying an abrasion using a spray tool.

62. A method as in claim 57 wherein said editing comprises decreasing a resolution of said image.

63. A method as in claim 56 further comprising storing, in a memory, a relationship between each color and an amount of effective applied energy representing the color.

64. A method as in claim 57 further comprising using a laser and controlling the laser to control an effective applied power applied to an area by controlling a duty cycle of the laser.

65. A method as in claim 64 wherein said duty cycle is controlled by selectively blocking and unblocking an output of said laser.

66. A method as in claim 64 wherein said duty cycle is controlled by turning on and off the laser.

67. A method of processing a garment, comprising:

defining a desired pattern to be formed on the garment and producing a computer file indicative thereof;

using said computer file with a laser having a maximum output power of 500 watts or greater, to scribe the desired pattern on said garment; and using said laser for thirty seconds or less to form said entire pattern.

68. A method as in claim 67 further comprising controlling an effective output power of said laser by controlling a duty cycle of operation thereof.

69. A method of forming a pattern on a garment comprising:

determining a pattern to be formed on a garment;

determining an effect that a directional characteristic of the material will have on the pattern to be formed; and specifying both said pattern and said directional characteristic.

70. A method as in claim 69, wherein said specifying includes forming a computer file indicative of areas, and effective power output levels associated with each said area.

71. A method as in claim 70, further comprising using said computer file to control a controllable laser, to form an effect on a material.

72. A method of processing a garment, comprising:

obtaining a first garment which has a desired look to be replicated;

determining color levels of different areas of a plurality of different areas of said first garment;

determining, from said color levels, an amount of effective applied energy of laser energy which will need to be applied to said each of said area to replicate said color level; and forming a computer file which has a plurality of area representations, each area representation associated with a power representation representing said amount of laser power which needs to be applied to each of said areas to replicate said different areas of said first garment.

73. A method as in claim 72 further comprising using said computer file to control a laser to mark a second garment in a way that replicates a pattern of the colors on the first garment.

74. A method as in claim 73 wherein said laser marks said second garment by scribing a plurality of lines on said second garment using said computer file.

75. An apparatus as in claim 74 wherein at least a plurality of said lines define an effective applied energy which varies within each of a plurality of single scanned lines.

76. A method as in claim 72 further comprising storing information in a look up table, and using said information to determine said effective applied energy for each of said areas.

77. A method as in claim 72 further comprising displaying a graphical image indicative of said computer file to a user and allowing said user to edit said graphical image to thereby edit said computer file.

78. A method comprising:

defining a pattern to be formed on a textile material, which pattern represents different degrees of abrasion of said textile material at different locations, and which represents at least first areas which have no abrasion, and producing a computer readable file indicative of said pattern; and controlling a laser to form said pattern by first controlling said laser according to said file to produce an effective output power in said first areas which is greater than zero, but is less than a threshold beyond which a visible change will be made to said textile material, and to increase the effective output power at a boundary between said first areas, and other areas outside said first areas.

79. A method comprising:

defining a pattern to be formed on a textile material, which pattern represents a plurality of sections, each section having a separately controllable amount of degree of change, said different degrees of change including at least a plurality of different levels of change;

randomizing a precise point at which the degree of change actually is bounded between two adjacent levels; and forming a computer-readable file indicating said pattern and information about said degree of change, including the randomized boundary.

80. A method as in claim 79, wherein said degree of change information is information about an effective applied power level for a laser, and said file includes said information associated with location information.

81. A method as in claim 80, further comprising using a laser to apply said effective applied power levels at specified locations represented by said location information.

82. A method as in claim 80, wherein said effective applied energy is one of an energy density per unit time, power level of a laser, a duty cycle of an output of a laser, a speed of movement of a laser, or a distance of a laser.

83. A method comprising:

defining a pattern to be formed on a textile material, which pattern has different colors representing different degrees of change of said textile material at different locations, said different degrees of change including at least a plurality of different levels of change, each different level of change associated with an effective applied energy to be applied to said location;

defining a tool which allows a spray of incremental intensity onto the pattern, by defining a droplet size and trajectory, determining a location that is hit by a droplet; adjusting a color level of said location based on said hit so that said effective applied energy is adjusted by said hitting.

84. A method as in claim 83, wherein said colors are one of full colors or gray scales.

85. A method as in claim 83, wherein said locations are pixels.

86. A method as in claim 83, wherein said adjusting comprises incrementing a color level of said location to a next higher color level.

87. A method as in claim 83, wherein said effective applied energy is one of an energy density per unit time, a duty cycle of an output of a laser, a speed of movement of a laser, a distance of a laser or a number of passes of a laser.

88. A method as in claim 83, wherein said adjusting comprises incrementing a color level of said location to a next lower color level.

89. A method of providing a variable effect to a material, comprising:

changing an effective applied power from a laser to a material by making multiple passes of laser scans along specific segments of the pattern, each of said passes being carried out at constant power, speed and laser distance, but the combination of said multiple scans providing a varied effective applied power at said material.

90. A method as in claim 89, wherein said changing comprises defining a file having different levels of effective applied energy, and using said file to control a number of said passes which are carried out in each of a plurality of areas.

91. A method as in claim 90, wherein said areas are pixels.

92. A method comprising:

authoring a special image intended for use in changing the color of textile fabric, which has differently colored areas representing different levels of change of color to said textile fabric; and using said image to form a file that controls a laser to carry out said changing of color of said textile fabric.

93. A method as in claim 92, wherein said file includes levels of effective applied energy associated with said levels of change of color.

94. A method as in claim 93, wherein said effective applied energy is one of an energy density per unit time, power level of a laser, a duty cycle of an output of a laser, a speed of movement of a laser, or a distance of a laser.

95. A method as in claim 92, wherein said file includes a separate effective applied energy value for each pixel of the image.

* * * * *